US009423767B2

(12) United States Patent
Fujino et al.

(10) Patent No.: US 9,423,767 B2
(45) Date of Patent: Aug. 23, 2016

(54) PACKING MEMBER AND CARTRIDGE PACKED IN THE PACKING MEMBER

(71) Applicant: CANON KABUSHIKI KAISHA, Tokyo (JP)

(72) Inventors: Toshiki Fujino, Tokyo (JP); Isao Koishi, Yokohama (JP); Tsutomu Sakaguchi, Tokyo (JP); Masayuki Takeuchi, Toda (JP); Taiji Watanabe, Yashio (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/396,537

(22) PCT Filed: Jun. 7, 2013

(86) PCT No.: PCT/JP2013/066409

§ 371 (c)(1),
(2) Date: Oct. 23, 2014

(87) PCT Pub. No.: WO2013/183793

PCT Pub. Date: Dec. 12, 2013

(65) Prior Publication Data

US 2015/0114870 A1 Apr. 30, 2015

(30) Foreign Application Priority Data

Jun. 8, 2012 (JP) ..... 2012-131295

(51) Int. Cl.
*G03G 21/16* (2006.01)
*B65D 81/02* (2006.01)
(Continued)

(52) U.S. Cl.
CPC ..... *G03G 21/1671* (2013.01); *B65D 43/162* (2013.01); *B65D 55/024* (2013.01); *B65D 81/025* (2013.01); *G03G 21/181* (2013.01)

(58) Field of Classification Search
USPC ..... 399/111
See application file for complete search history.

(56) References Cited

U.S. PATENT DOCUMENTS 2,217,455 A * 10/1940 Price ..... B65D 25/10 206/320
5,335,770 A * 8/1994 Baker ..... B65D 5/503 206/433

(Continued)

FOREIGN PATENT DOCUMENTS

EP 0 758 105 2/1997
JP S6-144683 3/1986

(Continued)

OTHER PUBLICATIONS

International Search Report in Application No. PCT/JP2013/066409, dated Jul. 6, 2013.

(Continued)

*Primary Examiner* — Rodney Fuller
(74) *Attorney, Agent, or Firm* — Fitzpatrick, Cella, Harper & Scinto

(57) ABSTRACT

A packing member for packing a cartridge which is detachably mountable to an image forming apparatus includes: a frame portion including an opening as an entrance for the cartridge, a first recessed portion for accommodating the cartridge, and a limiting portion, provided in the first recessed portion, for limiting a position of the cartridge with respect to the direction crossing a limiting portion of the cartridge; and a cap portion, provided rotatably connected to the frame portion by a hinge portion, for openably covering the opening. The limiting portion limits the position of the cartridge so that the cartridge is located in a position where a grip portion of the cartridge is remoter from the hinge portion than the center line of the cartridge with respect to the crossing direction and a direction crossing an entering direction in which the cartridge enters the frame portion.

20 Claims, 15 Drawing Sheets

(51) Int. Cl.

| | |
|---|---|
| ***B65D 43/16*** | (2006.01) |
| ***B65D 55/02*** | (2006.01) |
| ***G03G 21/18*** | (2006.01) |

(56) References Cited

U.S. PATENT DOCUMENTS

| | | | | |
|---|---|---|---|---|
| D395,234 | S * | 6/1998 | Shida | D9/423 |
| 5,871,097 | A | 2/1999 | Shida et al. | |
| 6,064,842 | A | 5/2000 | Takeuchi et al. | |
| 6,169,865 | B1 | 1/2001 | Miyabe et al. | |
| 6,321,911 | B1 | 11/2001 | Raimer et al. | |
| 6,349,182 | B2 | 2/2002 | Otsubo et al. | |
| 6,408,142 | B1 | 6/2002 | Takeuchi et al. | |
| 7,003,247 | B2 | 2/2006 | Koishi et al. | |
| 7,072,601 | B2 | 7/2006 | Kakitani et al. | |
| 7,128,211 | B2 | 10/2006 | Nishi et al. | |
| 7,139,502 | B2 | 11/2006 | Koishi et al. | |
| 7,158,749 | B2 | 1/2007 | Ueno et al. | |
| 7,184,690 | B2 | 2/2007 | Ueno et al. | |
| 7,243,815 | B2 * | 7/2007 | Coppedge | B65D 75/22 220/769 |
| 7,315,710 | B2 | 1/2008 | Ueno et al. | |
| 7,457,566 | B2 | 11/2008 | Koishi et al. | |
| 7,464,520 | B2 | 12/2008 | Nishi et al. | |
| 7,593,670 | B2 | 9/2009 | Matsuda et al. | |
| 7,681,379 | B2 | 3/2010 | Nishi et al. | |
| 7,813,671 | B2 | 10/2010 | Nittani et al. | |
| 7,856,192 | B2 | 12/2010 | Koishi et al. | |
| 7,890,012 | B2 | 2/2011 | Koishi et al. | |
| 8,116,660 | B2 | 2/2012 | Watanabe | |
| 8,139,979 | B2 | 3/2012 | Koishi et al. | |
| 8,526,841 | B2 | 9/2013 | Koishi et al. | |
| 8,862,015 | B2 | 10/2014 | Koishi et al. | |
| 8,960,467 | B2 * | 2/2015 | Miros | A45C 11/20 220/23.86 |
| 9,002,235 | B2 * | 4/2015 | Hymas | G03G 15/75 399/107 |
| 2003/0234251 | A1 * | 12/2003 | Hwang | B65D 43/162 220/4.23 |
| 2006/0042995 | A1 * | 3/2006 | McGrath | B65D 81/075 206/583 |
| 2009/0317129 | A1 | 12/2009 | Abe et al. | |
| 2012/0243905 | A1 | 9/2012 | Uratani et al. | |
| 2012/0301187 | A1 | 11/2012 | Ishikuro et al. | |
| 2014/0064776 | A1 | 3/2014 | Yamasaki et al. | |
| 2014/0064784 | A1 * | 3/2014 | Hayashi | G03G 21/181 399/111 |
| 2014/0270845 | A1 | 9/2014 | Kawakami et al. | |
| 2014/0361030 | A1 * | 12/2014 | Toba | G03G 21/181 220/821 |
| 2015/0153708 | A1 * | 6/2015 | Koishi | B65D 81/025 399/110 |

FOREIGN PATENT DOCUMENTS

| | | |
|---|---|---|
| JP | H04-114173 | 4/1992 |
| JP | H05-232752 A | 9/1993 |
| JP | 06-186895 | 7/1994 |
| JP | H10-29616 A | 2/1998 |
| KR | 10-267047 A | 9/2000 |
| TW | 201135379 A | 10/2011 |

OTHER PUBLICATIONS

Written Opinion of the International Search Authority in Application No. PCT/JP2013/066509.

Office Action in Taiwanese Patent Application No. 102120331, dated Feb. 10, 2015 (with English translation).

Office Action in Chinese Patent Application No. 201380029207.5 dated Dec. 3, 2015.

Office Action in Korean Patent Application No. 10-2014-7033865, dated Mar. 8, 2016.

Communication in European Patent Application No. 13 735 082.3, dated Feb. 1, 2016.

May 17, 2016 Japanese Office Action in Japanese Patent Application No. 2012-131295.

* cited by examiner (a)

(b)

PACKING MEMBER AND CARTRIDGE PACKED IN THE PACKING MEMBER

TECHNICAL FIELD

The present invention relates to a packing member for packing a cartridge detachably mountable to an image forming apparatus and relates to the cartridge packed in the packing member.

Examples of the image forming apparatus may include an electrophotographic copying machine, an electrophotographic printer (e.g., a laser beam printer, an LED printer or the like), a facsimile machine, a word processor, and the like. Further, the cartridge includes, e.g., an electrophotographic photosensitive member as an image bearing member, or is a cartridge prepared by integrally assembling the electrophotographic photosensitive member with a developing means acting on the electrophotographic photosensitive member into a unit, which is detachably mountable to the image forming apparatus.

Further, the packing member is used for protecting the cartridge from external vibration and impact when the cartridge is transported.

BACKGROUND ART

An electrophotographic image forming apparatus, such as a printer, using an electrophotographic process electrically charges uniformly the electrophotographic photosensitive member as the image bearing member and then forms a latent image by selective exposure of the electrophotographic photosensitive member to light. Then, the latent image is developed with the developer to be visualized as a developer image. The developer image is then transferred onto a recording material (medium).

By applying heat and pressure to the transferred developer image, the developer image is fixed on the recording material, so that an image is recorded.

Such a conventional electrophotographic image forming apparatus was accompanied with supply of the developer and maintenance of various process devices.

As a means for facilitating such a developer supplying operation and maintenance, all or a part of the electrophotographic photosensitive image, a charging means, the developing means, a cleaning means and the like are integrally assembled, as a process cartridge, in a frame. A process cartridge type in which the process cartridge is detachably mountable to the electrophotographic image forming apparatus is employed.

According to the process cartridge type, the maintenance of the process cartridge can be performed in the form of replacement by a user himself (herself), and therefore it was possible to remarkably improve productivity. With respect to such a detachably mountable, the user replaces the cartridge. In this case, in general, the cartridge is taken out from an electrophotographic image forming apparatus main assembly and then is replaced with a new cartridge.

Here, the fresh cartridge shipped from a manufacturing factory is packed in the packing member for protecting the cartridge from vibration and impact during transportation. Further, at the time when the new cartridge is mounted in the apparatus main assembly, the packing member is unpacked and then a grip portion of the cartridge is griped to take out the cartridge from the packing member. Then, the cartridge is mounted in the apparatus main assembly.

As the packing member for packing the cartridge and for protecting the cartridge from the vibration and impact during transportation, various packing members as described in Japanese Patent No. 3639834 and Japanese Laid-Open Patent Application (JP-A) Hei 4-114173.

Of these packing members, according to a constitution in JP-A Hei 4-114173, the packing member is a member prepared by extrusion (molding) along an outer configuration of the cartridge. The packing member is provided with many projections and recesses, by which the cartridge is supported. Further, openings at end portions of the packing member are covered with a cap (cover) molded correspondingly to the outer configuration of the cartridge.

However, constitutions of Japanese Patent No. 3639834 and JP-A Hei 4-114173 involve the following problem.

In order to fix the cartridge relative to the packing member, at each of end portions of the electrophotographic photosensitive member of the cartridge with respect to an axial direction of the photosensitive member, a cap as a separate member is provided, so that positional limitation of the cartridge with respect to the axial direction is made. For that reason, the constitution of the packing member complicated, and a cost was increased. Further, when the cartridge is taken out from the packing member, the cap of the packing member is slid from a side-surface opening of the packing member in the axial direction, thus being separated from the packing member. Then, the cartridge is slid in the axial direction, and thus is taken out from the packing member. That is, in order for the user to take out the cartridge from the packing member, complicate steps are required to be performed.

SUMMARY OF THE INVENTION

A principal object of the present invention is to provide a packing member capable of protecting a cartridge from vibration and impact during transportation.

Another object of the present invention is to provide the cartridge packed in the packing member.

According to an aspect of the present invention, there is provided a packing member for packing a cartridge which is detachably mountable to an image forming apparatus and which includes a grip portion provided, for gripping the cartridge, in a position deviated from a center line passing through a center of the cartridge with respect to a direction crossing a longitudinal direction of the cartridge, the packing member comprising: (i) a frame portion including an opening as an entrance for the cartridge, a first recessed portion for accommodating the cartridge, and a limiting portion, provided in the first recessed portion, for limiting a position of the cartridge with respect to the direction crossing the longitudinal direction; and (ii) a cap portion, provided rotatably connected to the frame portion by a hinge portion, for openably covering the opening, wherein the limiting portion limits the position of the cartridge so that the cartridge is located in a position where the grip portion is remoter from the hinge portion than the center line of the cartridge with respect to the direction crossing the longitudinal direction of the cartridge and a direction crossing an entering direction in which the cartridge enters the frame portion.

According to another aspect of the present invention, there is provided a packing member for packing a cartridge which is detachably mountable to an image forming apparatus and which includes a first frame including a grip portion for gripping the cartridge and includes a second frame connected to the first frame the packing member comprising: (i) a frame portion including an opening as an entrance for the cartridge, a first recessed portion for accommodating the cartridge, and a limiting portion, provided in the first recessed portion, for limiting a position of the cartridge with respect to a direction crossing a longitudinal direction of the cartridge; and (ii) a cap portion, provided rotatably connected to the frame portion by a hinge portion, for openably covering the opening, wherein the limiting portion limits the position of the cartridge so that the grip portion is located in a position remoter from the hinge portion than the second frame with respect to the direction crossing the longitudinal direction of the cartridge and a direction crossing an entering direction in which the cartridge enters the frame portion.

According to another aspect of the present invention, there is provided a cartridge, packed in a packing member, detachably mountable to an image forming apparatus, wherein the cartridge includes a grip portion provided, for gripping the cartridge, in a position deviated from a center line passing through a center of the cartridge with respect to a direction crossing a longitudinal direction of the cartridge, and wherein the packing member comprises: (i) a frame portion including an opening as an entrance for the cartridge, a first recessed portion for accommodating the cartridge, and a limiting portion, provided in the first recessed portion, for limiting a position of the cartridge with respect to the direction crossing the longitudinal direction; and (ii) a cap portion, provided rotatably connected to the frame portion by a hinge portion, for openably covering the opening, wherein the limiting portion limits the position of the cartridge so that the cartridge is located in a position where the grip portion is remoter from the hinge portion than the center line of the cartridge with respect to the direction crossing the longitudinal direction of the cartridge and a direction crossing an entering direction in which the cartridge enters the frame portion.

According to a further aspect of the present invention, there is provided a cartridge, packed in a packing member, detachably mountable to an image forming apparatus wherein the cartridge includes a first frame including a grip portion for gripping the cartridge and includes a second frame connected to the first frame and wherein the packing member comprises: (i) a frame portion including an opening as an entrance for the cartridge, a first recessed portion for accommodating the cartridge, and a limiting portion, provided in the first recessed portion, for limiting a position of the cartridge with respect to a direction crossing a longitudinal direction of the cartridge; and (ii) a cap portion, provided rotatably connected to the frame portion by a hinge portion, for openably covering the opening, wherein the limiting portion limits the position of the cartridge so that the grip portion is located in a position remoter from the hinge portion than the second frame with respect to the direction crossing the longitudinal direction of the cartridge and a direction crossing an entering direction in which the cartridge enters the frame portion.

These and other objects, features and advantages of the present invention will become more apparent upon a consideration of the following description of the preferred embodiments of the present invention taken in conjunction with the accompanying drawings.

Figure 4:
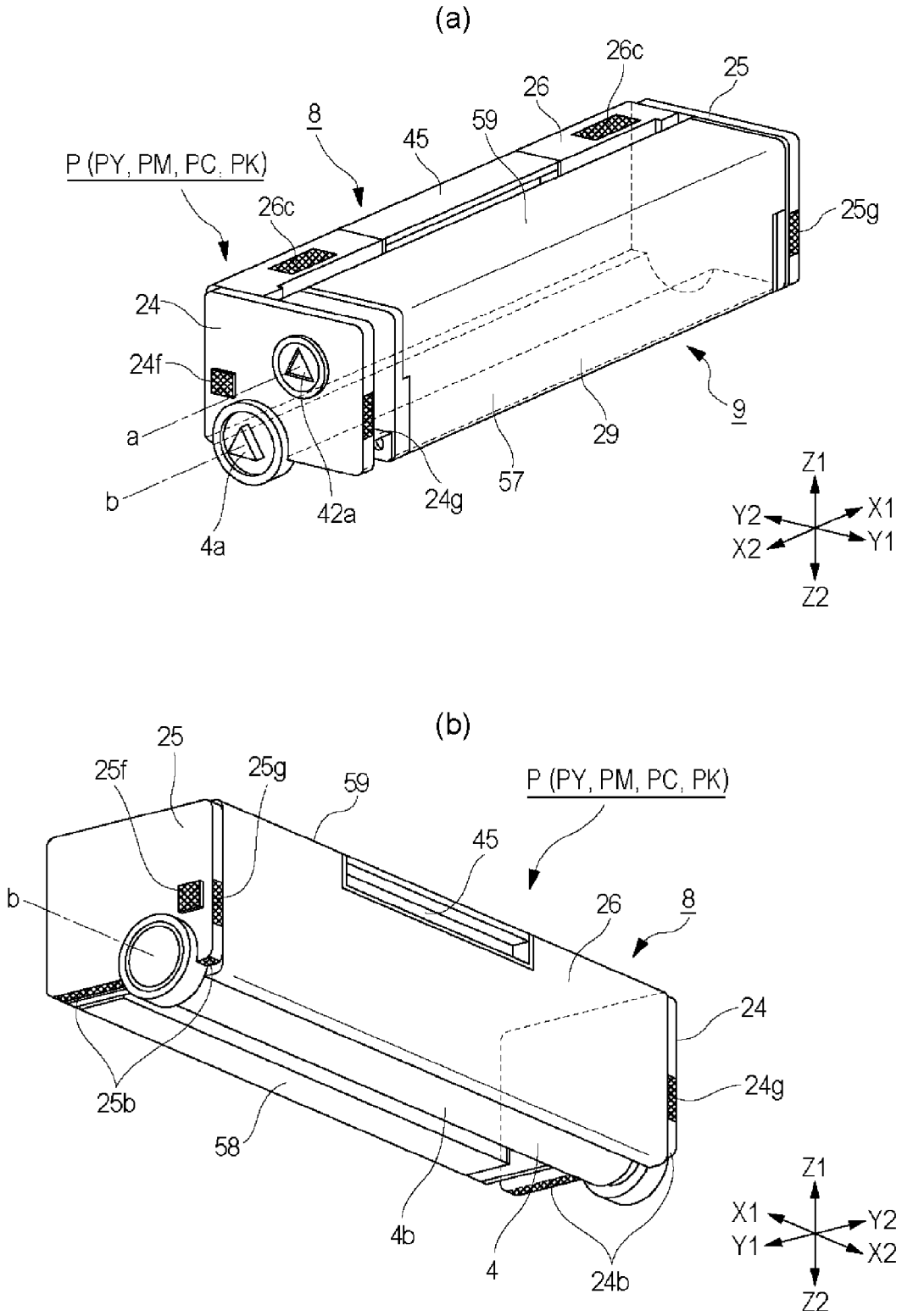

Parts (a) and (b) of FIG. 4 are schematic perspective views each showing an example of the cartridge in Embodiment 1.

Figure 5:
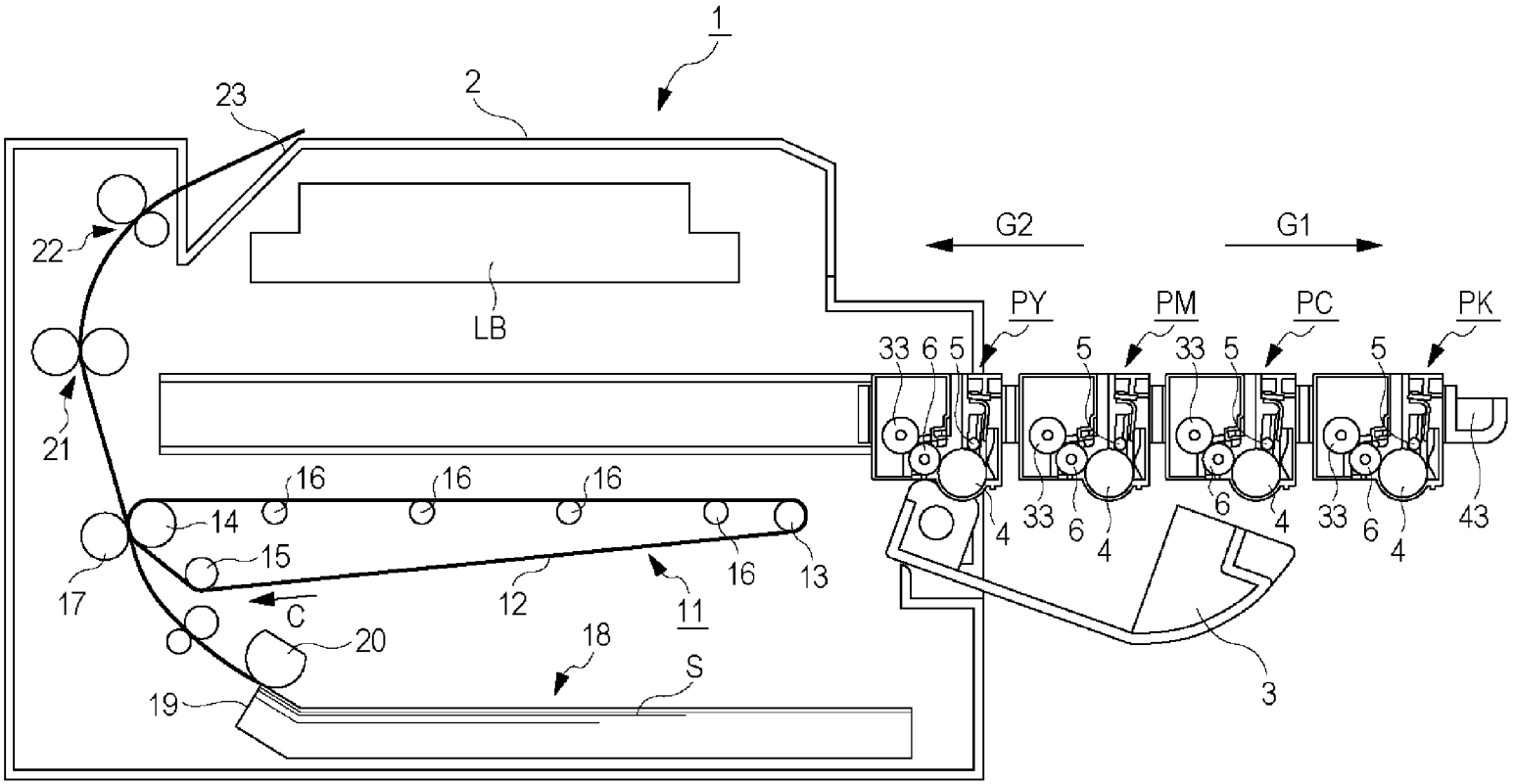

FIG. 5 is a schematic sectional view showing a state of an image forming apparatus in which the cartridge is detachably mountable to the apparatus main assembly in Embodiment 1.

Figure 6:
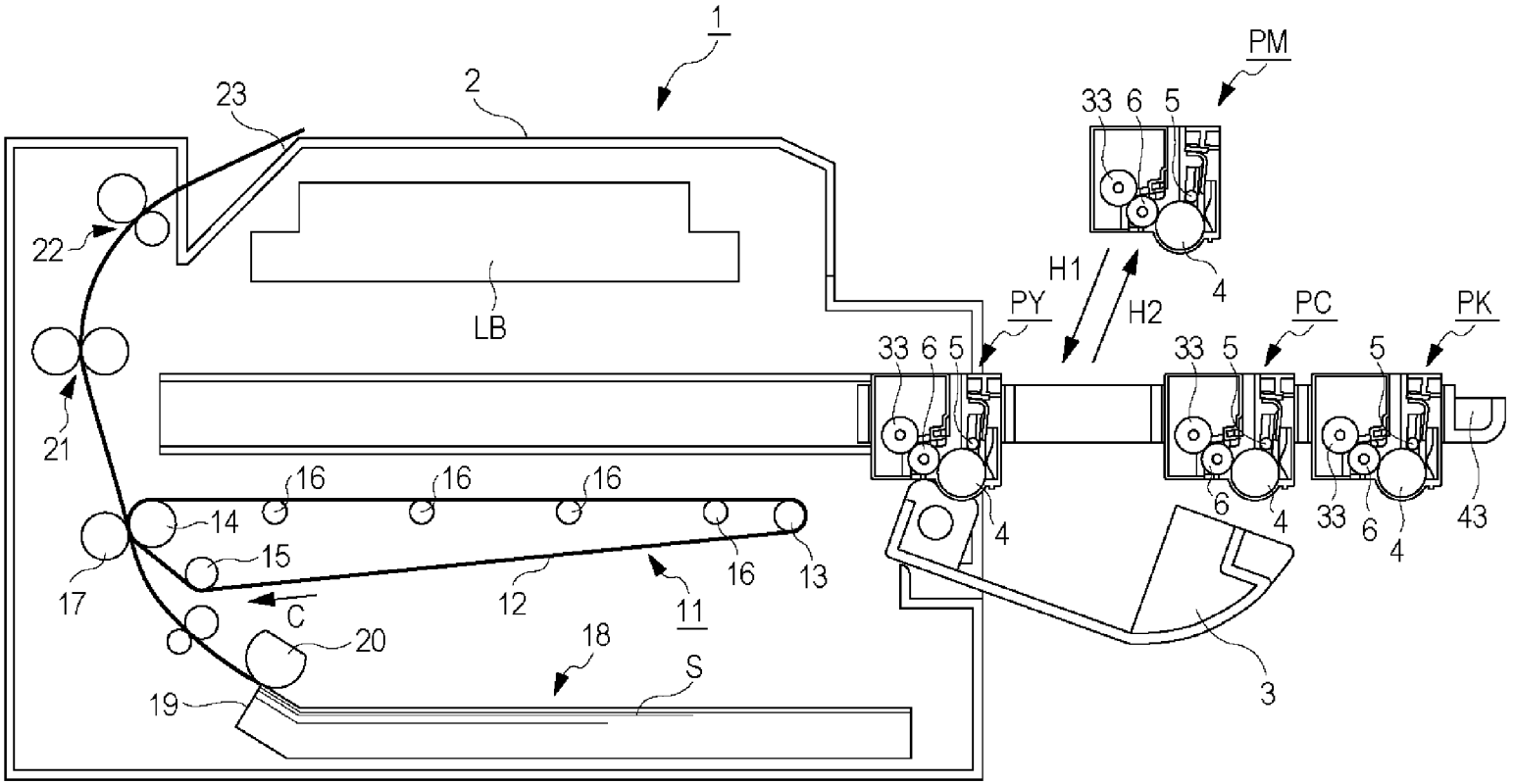

FIG. 6 is a schematic sectional view showing an operation in which the cartridge is demounted from and mounted in a cartridge tray in Embodiment 1.

Figure 7:
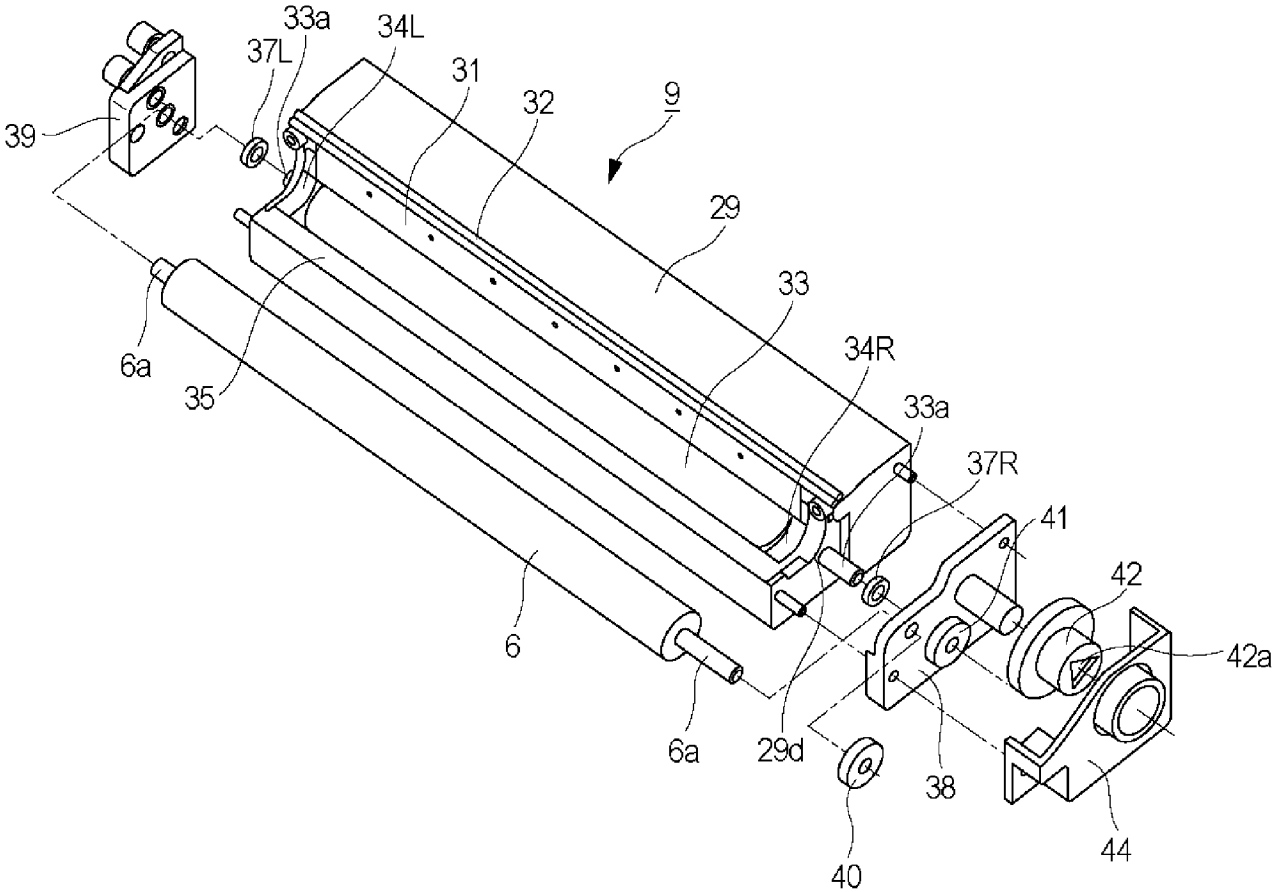

FIG. 7 is a schematic perspective view showing an example of a developing device in Embodiment 1.

Figure 8:
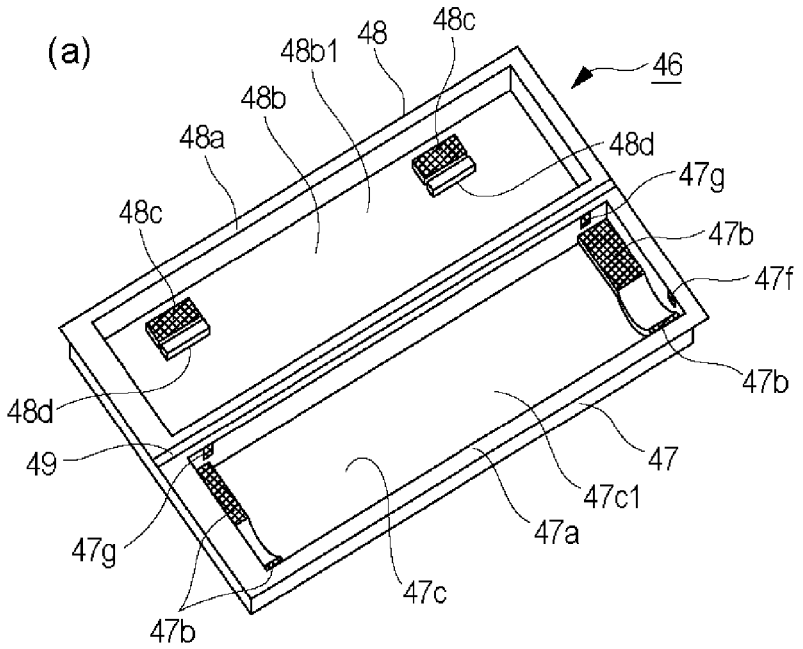
Figure 8:
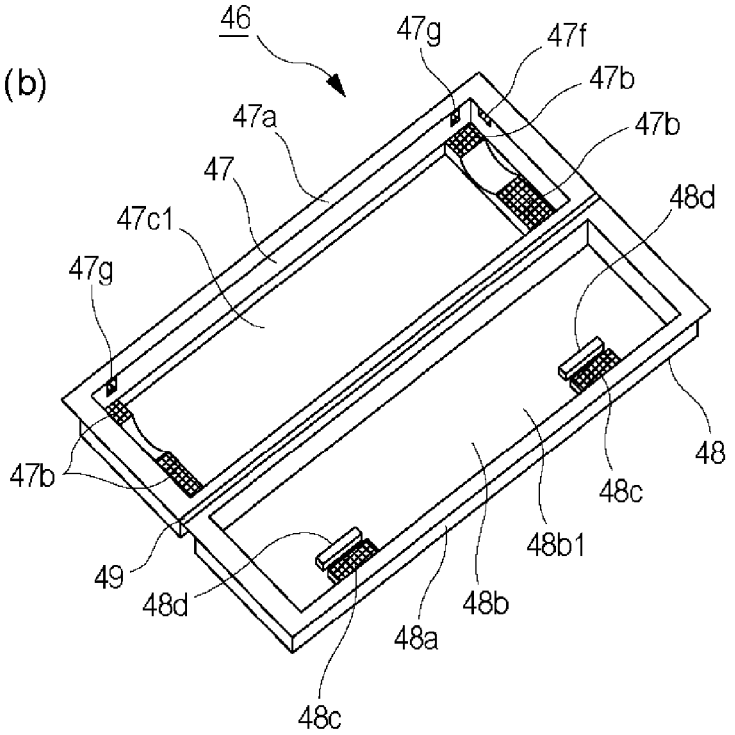

Parts (a) and (b) of FIG. 8 are schematic perspective views each showing the packing member in Embodiment 1.

Figure 9:
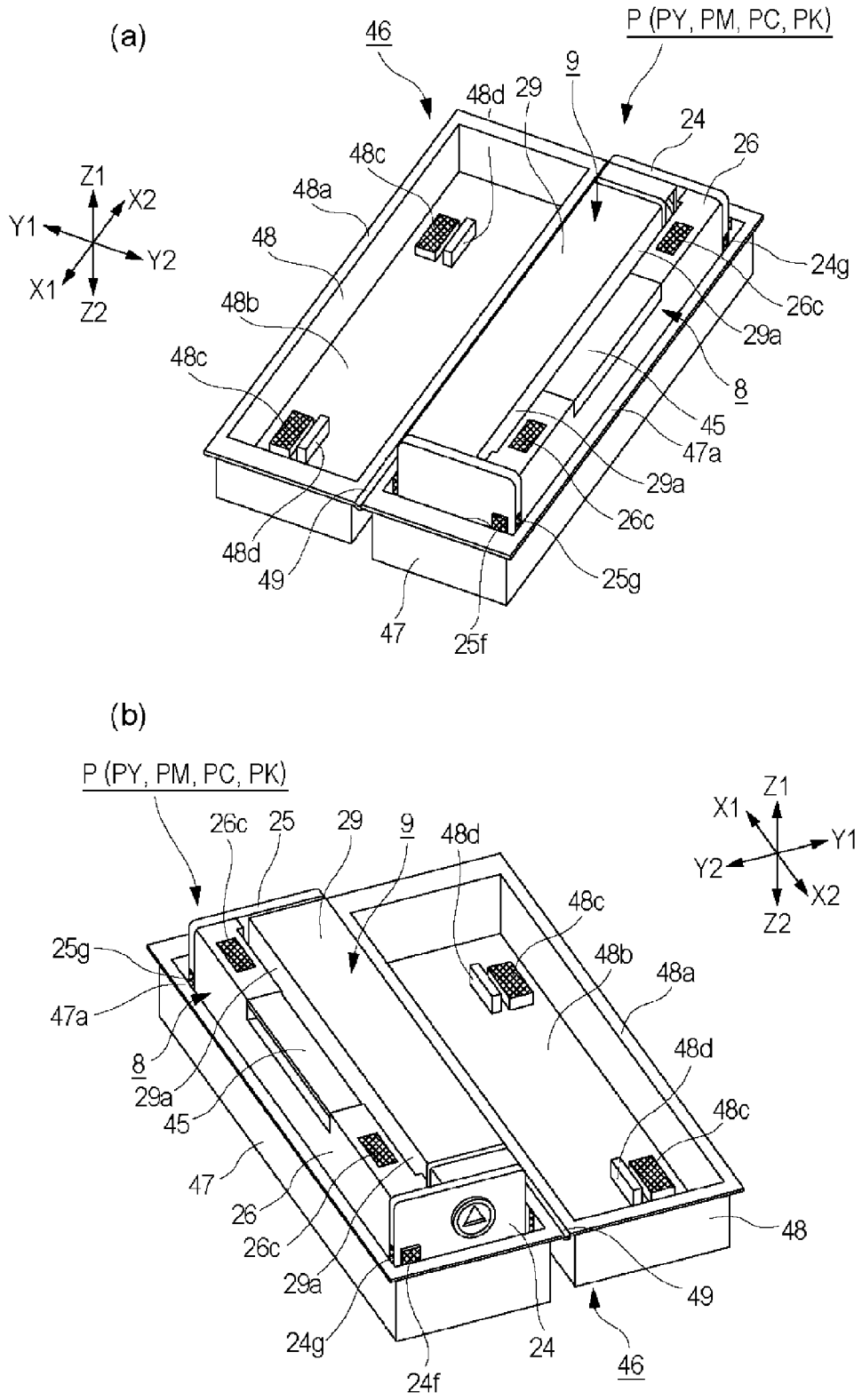

Parts (a) and (b) of FIG. 9 are schematic perspective views each showing a state in which the cartridge is detachably from the packing member in Embodiment 1.

Figure 10:
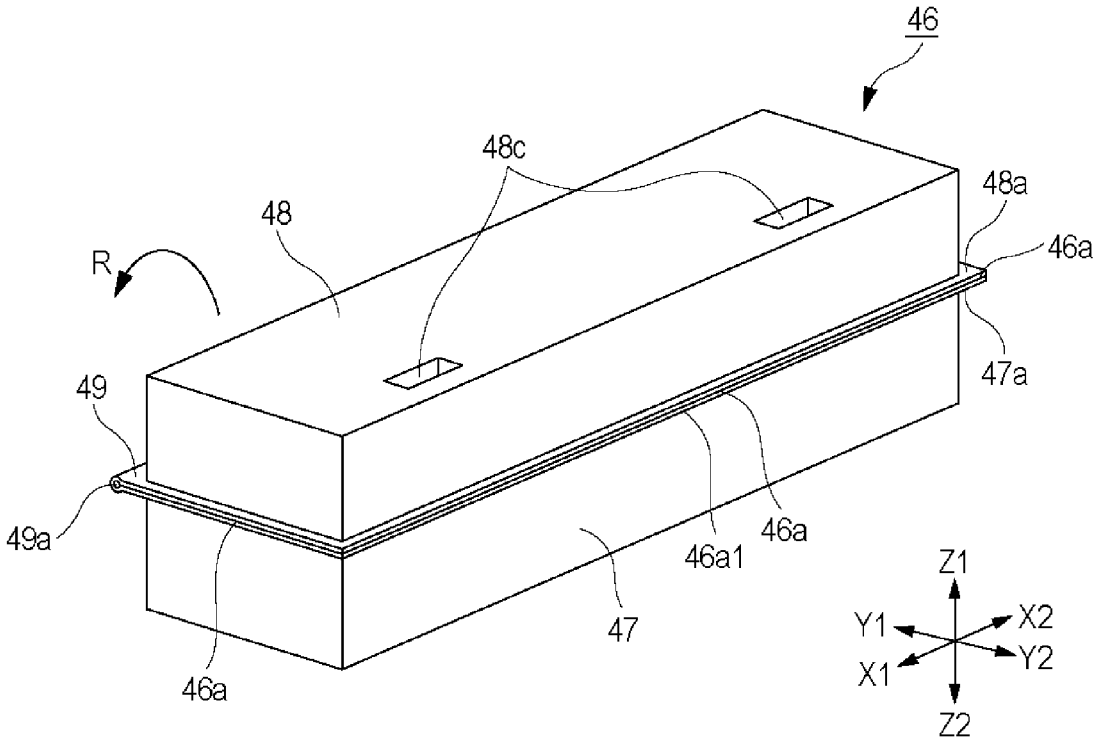

FIG. 10 is a schematic perspective view showing a cartridge packing state of the packing member in Embodiment 1.

Figure 11:
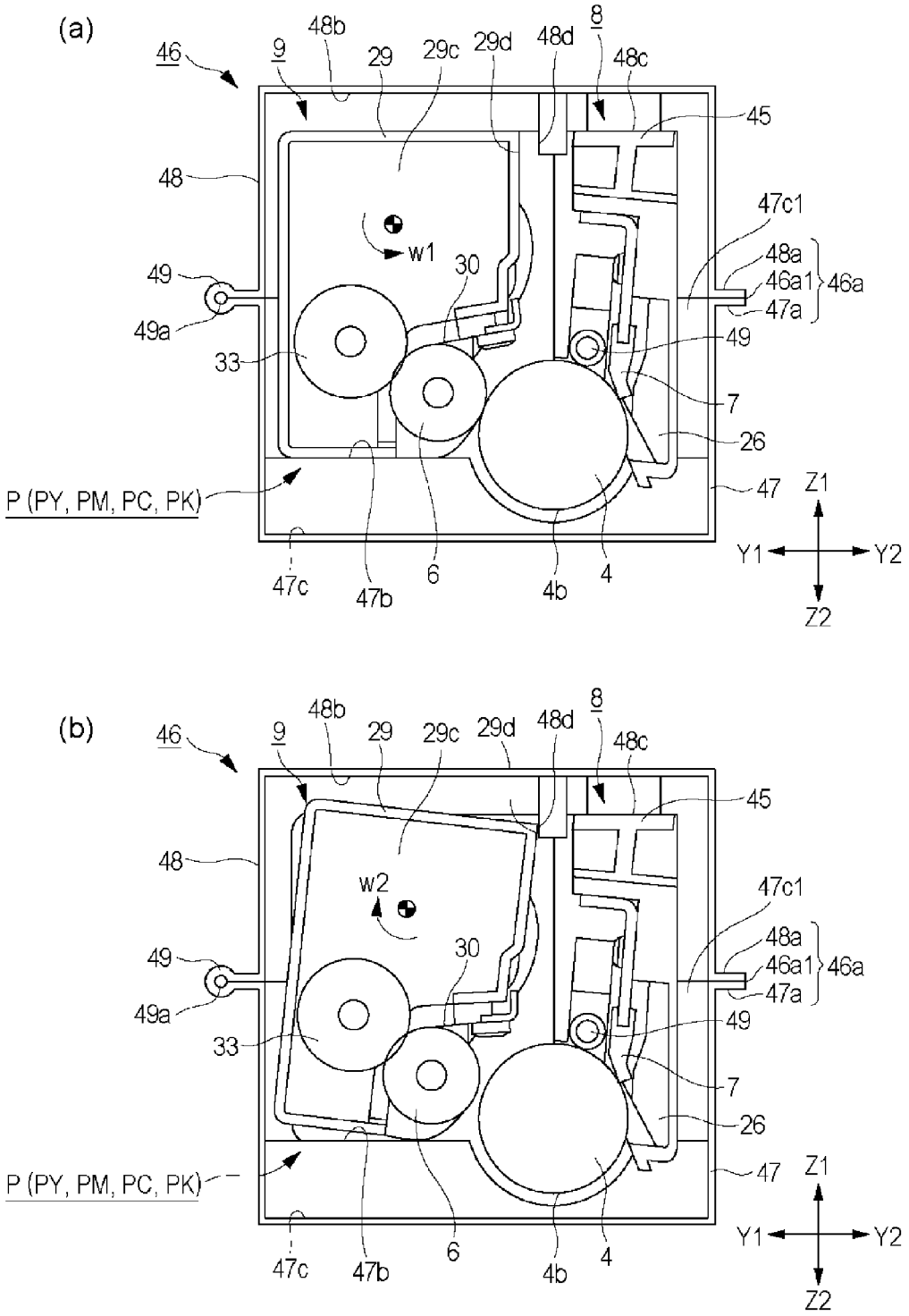

Parts (a) and (b) of FIG. 11 are schematic sectional views each showing the cartridge and the cartridge packing state of the packing member in Embodiment 1.

Figure 12:
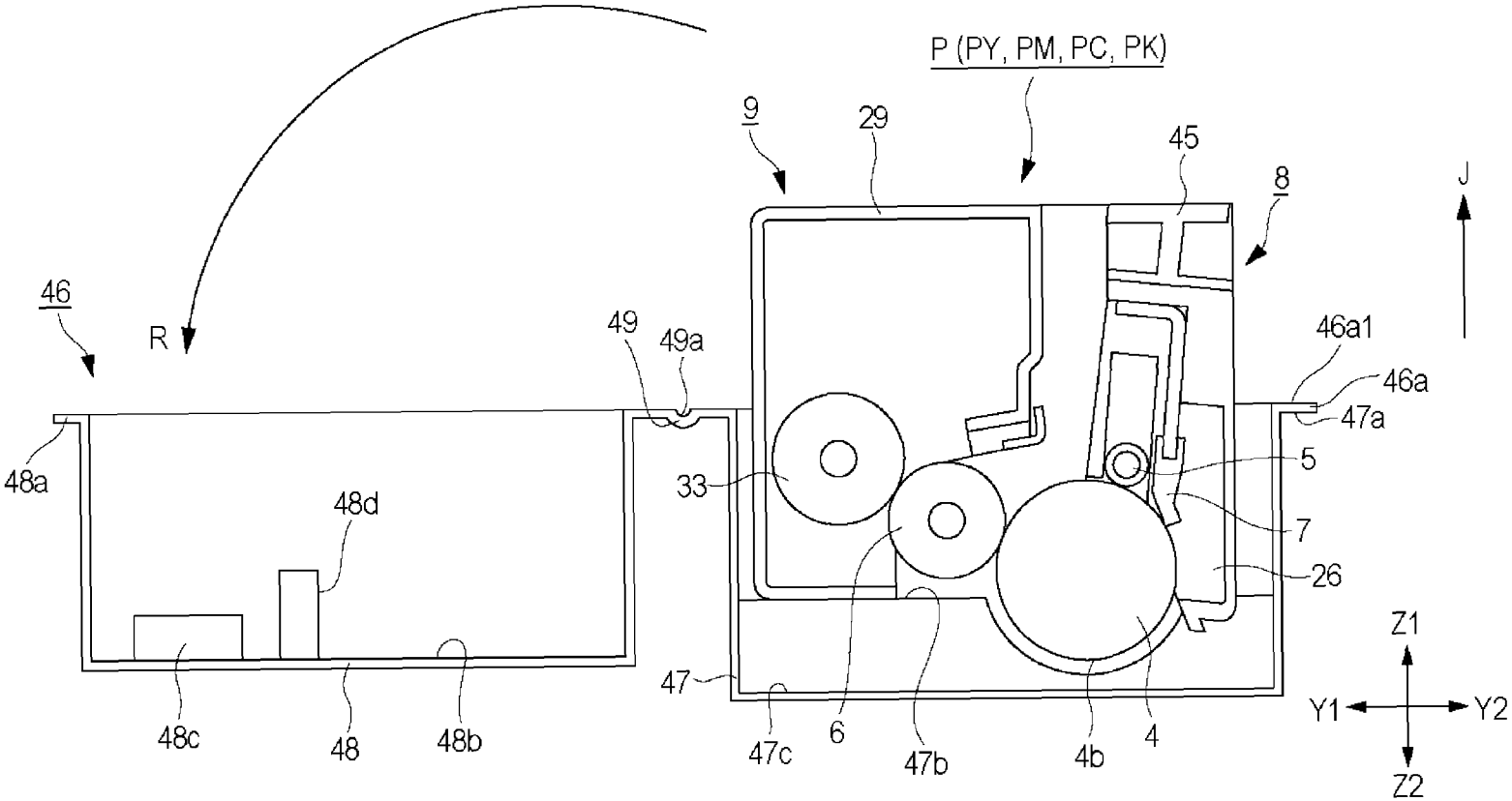

FIG. 12 is a schematic sectional view showing an unpacked state of the packing member in which the cartridge is packed in Embodiment 1.

Figure 13:
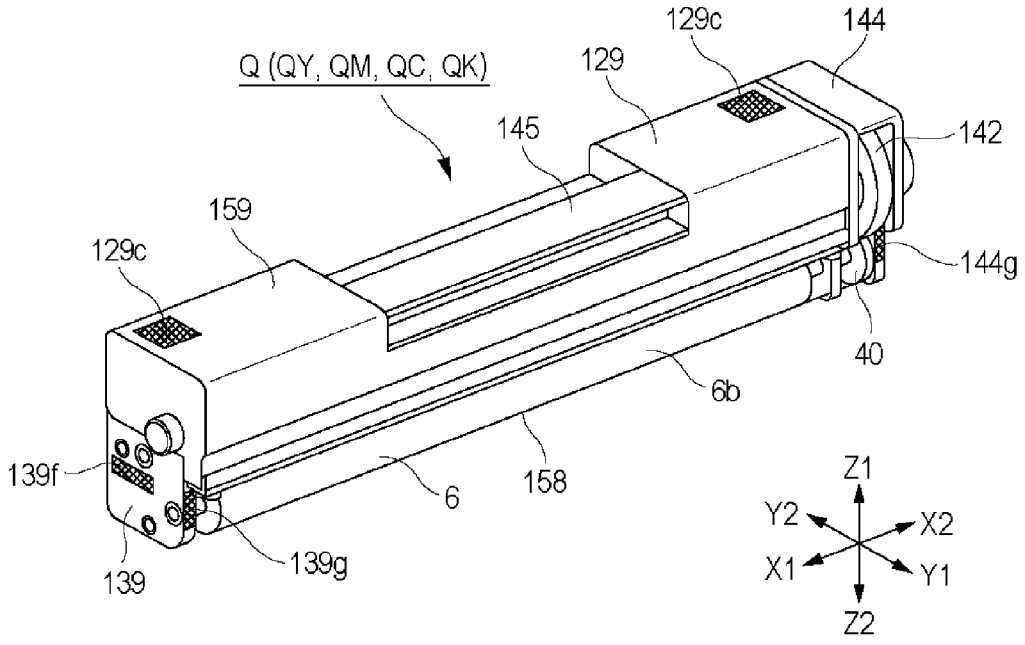
Figure 13:
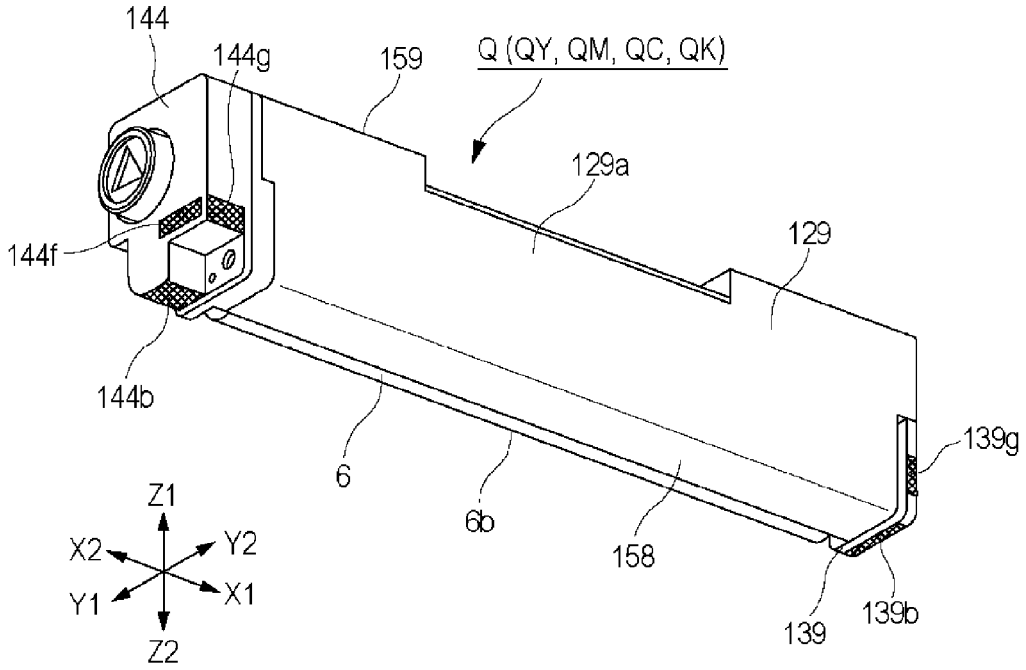

Parts (a) and (b) of FIG. 13 are schematic perspective views each showing an example of a developing device in Embodiment 2.

Figure 14:
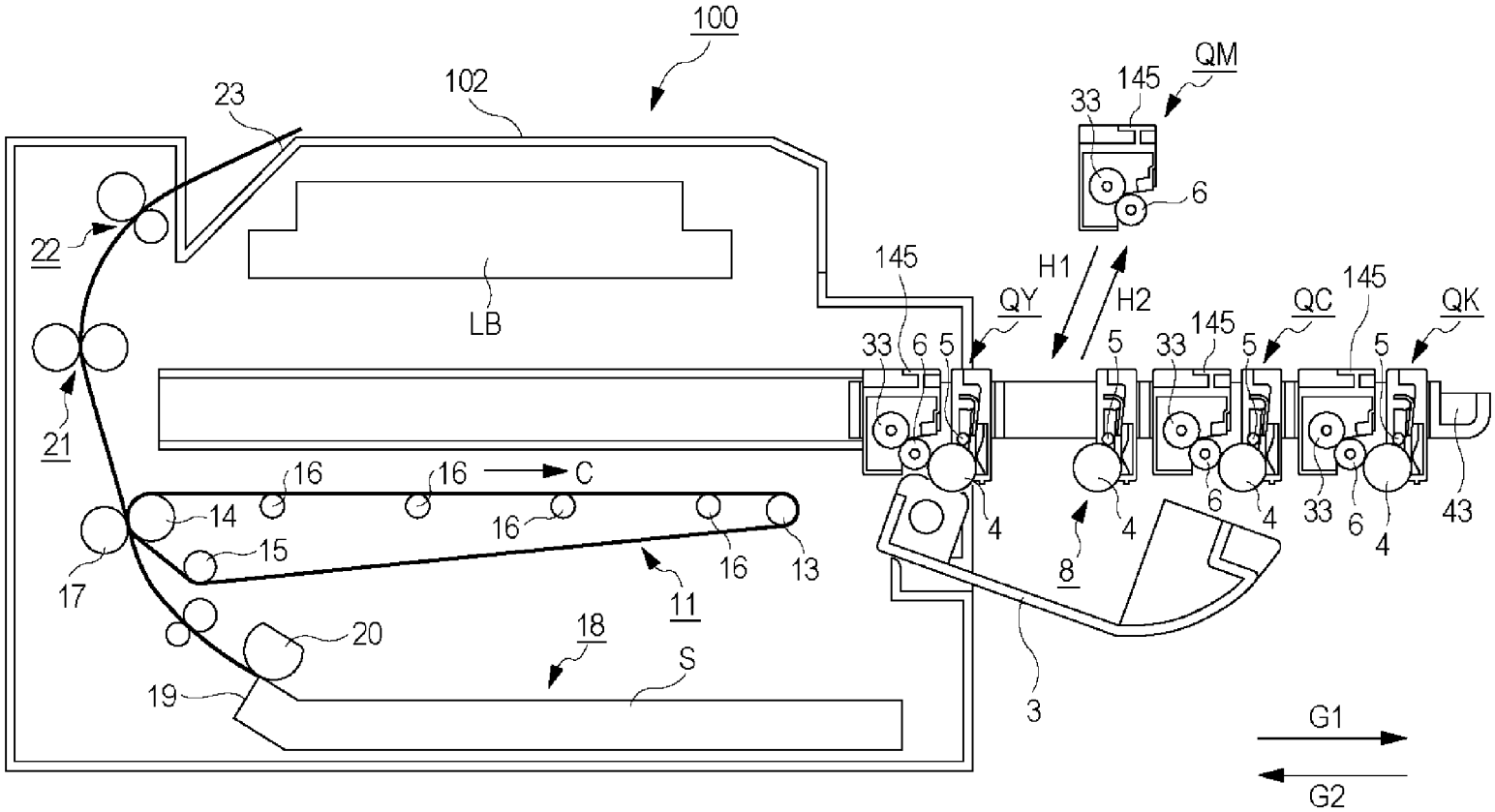

FIG. 14 is a schematic sectional view showing a state in which the developing device is detachably mountable to the apparatus main assembly in Embodiment 2.

Figure 15:
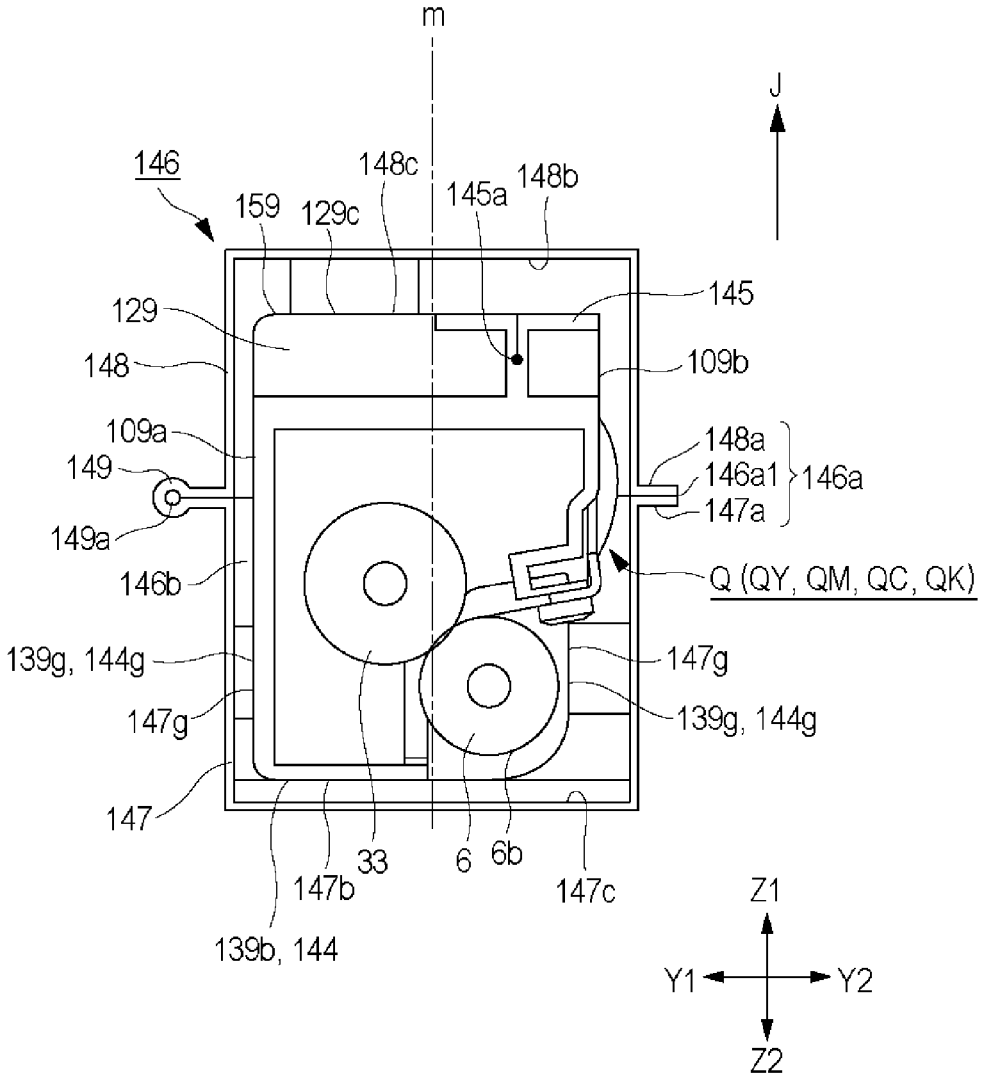

FIG. 15 is a schematic sectional view showing a packing member in which the developing device is packed in Embodiment 2.

DESCRIPTION OF EMBODIMENTS

Embodiment 1

Embodiment 1 of the present invention will be described with reference to FIGS. 2 to 12.

Incidentally, in the following embodiments, as an electrophotographic image forming apparatus, a full-color electrophotographic image forming apparatus to which four cartridges are detachably mountable is described as an example.

However, the number of the cartridges to be mounted in the image forming apparatus is not limited to four but may appropriately be set as desired.

For example, in the case of an image forming apparatus for forming a monochromatic image, the number of the cartridges to be mounted in the image forming apparatus is one. Further, in the following embodiments, as an example of the image forming apparatus, a printer is exemplified.

However, the image forming apparatus is not limited to the printer. The present invention is also applicable to, e.g., other image forming apparatuses such as a copying machine, a facsimile machine and a multi-function machine having functions of these machines in combination.

<General Structure of Image Forming Apparatus>

Figure 2:
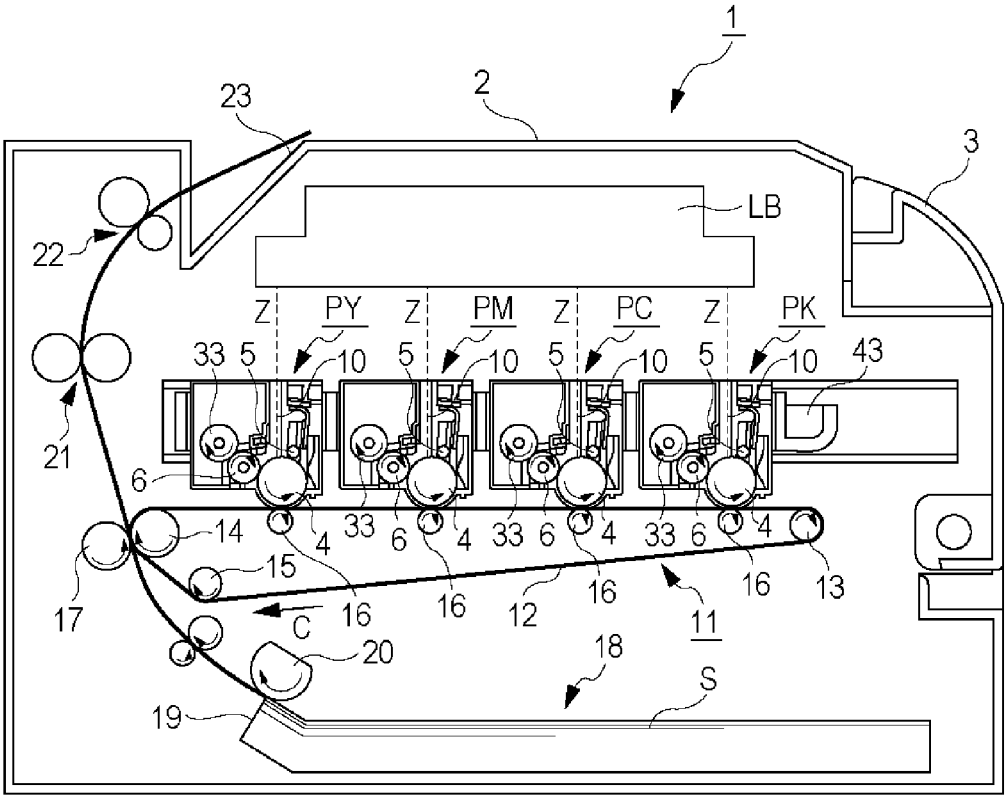
FIG. 2 is a schematic sectional view showing an example of an image forming apparatus main assembly in Embodiment 1.

First, FIG. 2 is a schematic sectional view of the image forming apparatus in this embodiment.

As shown in FIG. 2, an image forming apparatus 1 is a four color-based full-color laser printer using the electrophotographic image forming process and effects color image formation on a recording material S. The image forming apparatus 1 is of a process cartridge type in which the process cartridge is detachably mountable to an apparatus main assembly 2 and a color image is formed on the recording material S.

Here, with respect to the image forming apparatus 1, the side (surface) on which an openable door 3 is provided is referred to as a front side (surface), and a side (surface) opposite to the front side (surface) is referred to as a rear side (surface). Further, a right side when the image forming apparatus 1 is viewed from the front surface is referred to as a driving side, and a left side is referred to as a non-driving side.

In the apparatus main assembly 2, four cartridges P consisting of a first cartridge PY, a second cartridge PM, a third cartridge PC and a fourth cartridge PK are provided and arranged in a horizontal direction. The respective first to fourth cartridges (PY to PK) have the same electrophotographic process mechanism but contains developers (toners) different in color from one another. To the first to fourth cartridges P (PY to PK), a rotational driving force is transmitted from a drive output portion (not shown) of the apparatus main assembly 2. Further, to the first to fourth cartridges P (PY to PK), bias voltages (charging bias, developing bias and the like) are supplied from the apparatus main assembly 2 (not shown).

Each of the first to fourth cartridges P (PY to PK) includes a first frame including an electrophotographic photosensitive member (hereinafter referred to as a photosensitive drum) 4, and including a charging means and a cleaning means which are used as process means acting on the photosensitive drum 4. The first frame is referred to as a cleaning unit 8.

Further, each of the first to fourth cartridges P (PY to PK) includes a developing device 9 which is a second frame including a developing means for developing an electrostatic latent image on the photosensitive drum 4.

The cleaning unit 8 and the developing device 9 are connected with each other. As the charging means, a charging roller 5 is used. As the cleaning means, a cleaning blade 7 is used. As the developing means, a developer carrying member (hereinafter referred to as a developing roller) 6 is used. A more specific constitution of the cartridges will be described below.

The first process cartridge PY accommodates the toner of yellow (Y) in its developing (device) frame 29 and forms the toner image of yellow on the surface of the photosensitive drum 4. The second process cartridge PM accommodates the toner of magenta (M) in its developing frame 29 and forms the image of magenta on the surface of the photosensitive drum 4. The process third cartridge PC accommodates the toner of cyan (C) in its developing frame 29 and forms the toner image of cyan on the surface of the photosensitive drum 4. The fourth process cartridge PK accommodates the toner of black (K) in its developing frame 29 and forms the toner image of black on the surface of the photosensitive drum 4.

As shown in FIG. 2, above the first to fourth process cartridges P (PY, PM, PC, PK), a laser scanner unit LB as an exposure means is provided. This laser scanner unit LB outputs laser light Z correspondingly to image information. Then, the laser light Z passes through an exposure window portion 10 of each cartridge P, so that the surface of the photosensitive drum 4 is subjected to scanning exposure to the laser light Z.

Under the first to fourth cartridges P (PY, PM, PC, PK), an intermediary transfer belt unit 11 as a transfer member is provided. This intermediary transfer belt unit 11 includes a driving roller 13, a turn roller 14 and a tension roller 15, and includes a transfer belt 12 extended and stretched by the rollers. The photosensitive drum 4 of each of the first to fourth process cartridges P (PY to PK) is contacted to an upper surface of the transfer belt 12 at its lower surface. A resultant contact portion is a primary transfer portion. Inside the transfer belt 12, primary transfer rollers 16 are provided opposed to the associated photosensitive drums 4. Oppositely to the turn roller 14, a secondary transfer roller 17 is provided in contact with the transfer belt 12. A resultant contact portion between the transfer belt 12 and the secondary transfer roller 17 is a secondary transfer portion.

Below the intermediary transfer belt unit 11, a sheet feeding unit 18 is provided. This sheet feeding unit 18 includes a sheet feeding tray 19 in which sheets of the recording material S are stacked, and includes a sheet feeding roller 20 and the like.

In an upper left side of the apparatus main assembly 2 in FIG. 2, a fixing unit 21 and a sheet discharging unit 22 are provided. At an upper surface of the apparatus main assembly 2, a sheet discharge tray 23 is defined.

On the recording material S, the toner image is fixed by the fixing means provided in the fixing unit 21, and then the recording material S is discharged onto the discharge tray 23.

<Image Forming Operation>

Next, an operation for forming a full-color image is as follows. The photosensitive drums 4 of the first to fourth cartridges P (PY to PK) are rotationally driven at a predetermined speed (in an arrow D direction in FIG. 3 and in a counterclockwise direction in FIG. 2). The transfer belt 12 is also rotationally driven in the same direction (arrow C direction in FIG. 2) as the rotational direction of the photosensitive drums 4 (at their contact portions) at a speed corresponding to the speed of the photosensitive drums 4.

The laser scanner unit LB is also driven. In synchronism with the drive of the laser scanner unit LB, the surface of the photosensitive drum 4 of each cartridge P is electrically charged to a predetermined polarity and a predetermined potential by the charging roller 5. The scanner unit LB scans and exposes the surface of each photosensitive drum 4 with the laser light Z depending on an associated signal. As a result, the electrostatic latent image depending on the image signal for the associated color is formed on the surface of each photosensitive drum 4. The thus formed electrostatic latent image is developed by the developing roller 6 which is rotationally driven (in an arrow E direction in FIG. 3 or in the clockwise direction in FIG. 2) at a predetermined speed.

By the electrophotographic image forming process operation as described above, on the photosensitive drum 4 of the first cartridge PY, a yellow toner image corresponding to a yellow component for the full-color image is formed. Then, the toner image is primary-transferred onto the transfer belt 12.

Similarly, on the photosensitive drum 4 of the second cartridge PM, a magenta toner image corresponding to a magenta component for the full-color image is formed. Then, the toner image is primary-transferred superposedly onto the yellow toner image which has already been transferred on the transfer belt 12.

Similarly, on the photosensitive drum 4 of the third cartridge PC, a cyan toner image corresponding to a cyan component for the full-color image is formed. Then, the toner image is primary-transferred superposedly onto the yellow and magenta toner images which have already been transferred on the transfer belt 12.

Similarly, on the photosensitive drum 4 of the fourth cartridge PK, a black toner image corresponding to a black component for the full-color image is formed. Then, the toner image is primary-transferred superposedly onto the yellow, magenta and cyan toner images which have already been transferred on the transfer belt 12.

In this way, unfixed toner images of yellow, magenta, cyan and black for the four color-based full-color image are formed on the transfer belt 12.

On the other hand, at predetermined control timing, sheets of the recording material S are separated and fed one by one. The recording material S is introduced into a secondary transfer portion which is a contact portion between the secondary transfer roller 17 and the transfer belt 12 with predetermined control timing. As a result, in a process in which the recording material S is conveyed to the secondary transfer portion, the four color toner images superposed on the transfer belt 12 are collectively transferred onto the surface of the recording material S.

<Structure of Cartridge>

Parts (a) and (b) of FIG. 4 are schematic perspective views of each cartridge P (PY, PM, PC, PK) as seen from different angles (directions). In the following description, the respective cartridges P (PY to PK) have the same constitution, and therefore are collectively described as the cartridge P.

The cartridge P has a substantially rectangular parallelopiped shape extending in a direction of a rotational axis a of the photosensitive drum 4 as a longitudinal direction (arrow X direction), and includes the cleaning unit f, the developing device 9, a driving-side cover member 24 and a non-driving-side cover member 25.

Part (a) of FIG. 4 is the schematic perspective view of the cartridge P as seen from the driving side, and (b) of FIG. 4 is the schematic perspective view as seen from the non-driving side. The cartridge P has a two-frame structure in which the driving-side cover member 24 and the non-driving-side cover member 25 which are fixed on the cleaning unit 8 support rotatably the developing device 9 about a swing center (axis a indicated by a chain line in (a) of FIG. 4) of the developing device 9. Incidentally, the developing device 9 is urged in a certain direction (arrow W1 direction in FIG. 3) by a spring (not shown) or the like although specifically described later.

Figure 3:
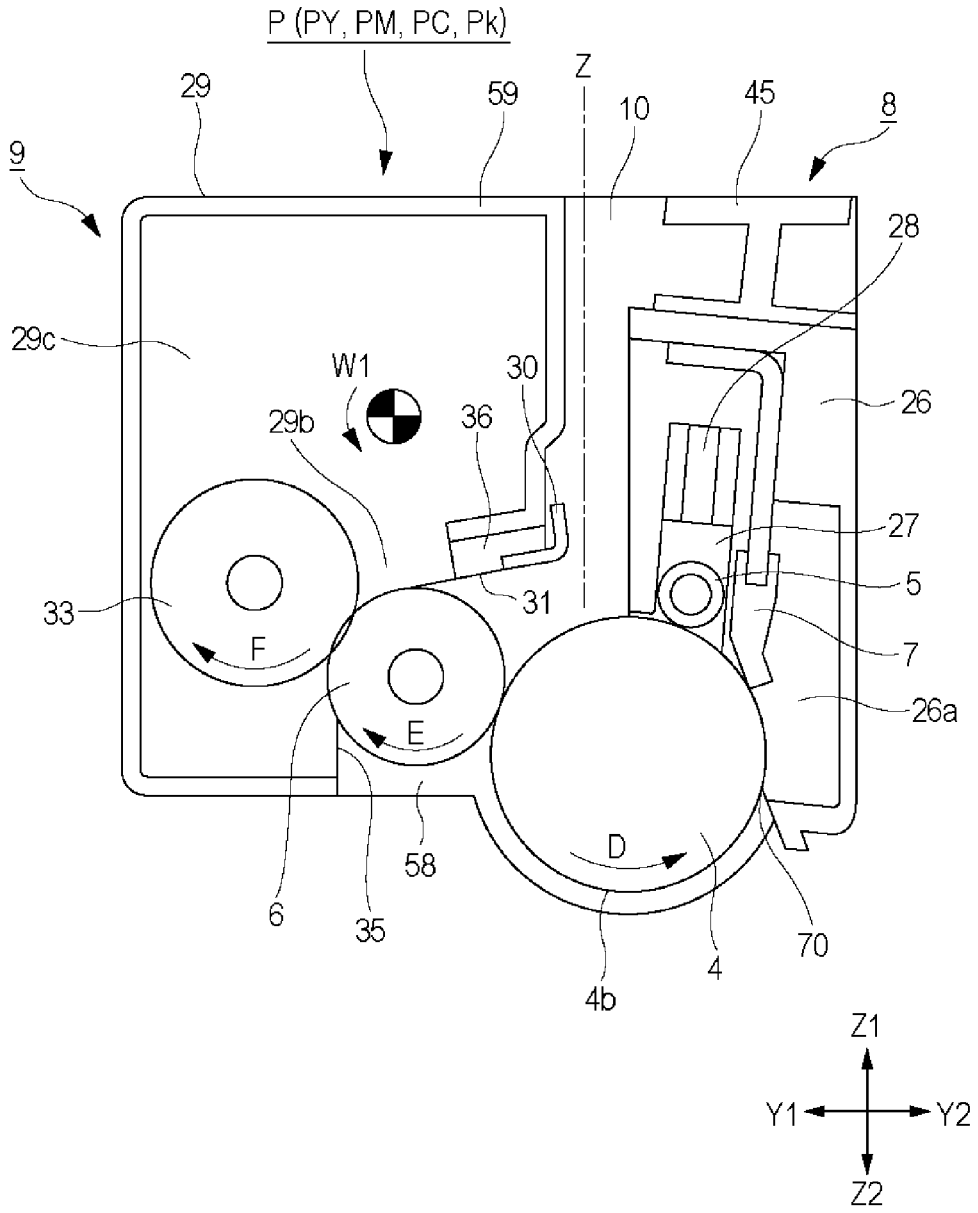
FIG. 3 is a schematic sectional view showing an example of the cartridge in Embodiment 1.

As shown in FIG. 3, the cleaning unit (drum unit) 8 is constituted by the photosensitive drum 4, the charging roller 5, a cleaning container 26 including the cleaning blade 7, and a grip portion 45. As shown in (a) and (b) of FIG. 4, the photosensitive drum 4 is rotatably supported by the driving-side cover member 24 and the non-driving-side cover member 25, and obtains a driving force of a motor (not shown) of the apparatus main assembly 2 from drum driving coupling 4*a*, and thus is rotationally driven (in the arrow D direction in FIG. 3).

As shown in FIG. 3, the charging roller 5 is rotatably supported at its end portions by charging roller bearings 27 of the cleaning container 26 and is driven by rotation of the photosensitive drum 4 in contact with the surface of the photosensitive drum 4. At this time, in order to uniformly charge the surface of the photosensitive drum 4, the charging roller 5 is urged against the photosensitive drum 4 by a charging roller urging spring 28 at each of the end portions thereof. The cleaning blade 7 is fixed on the cleaning container 26, and an elastic rubber end portion thereof is disposed in contact with the photosensitive drum 4 in a direction counterdirectionally to the rotational direction (the arrow D direction in FIG. 3). During image formation, the cleaning blade 7 scrapes off a transfer residual toner remaining on the photosensitive drum 4 to clean the surface of the photosensitive drum 4. At this time, the end of the cleaning blade 7 is contacted to the surface of the photosensitive drum 4 at predetermined pressure in order to scrape off the transfer residual toner completely.

Further, the transfer residual toner scraped off from the surface of the photosensitive drum 4 by the cleaning blade 7 is accommodated as a waste (residual) toner in a residual toner accommodating portion 26*a* of the cleaning container 26. For that purpose, on the cleaning container 26, a residual toner collecting sheet member 70 for preventing the residual toner from leaking out from a gap between itself and the photosensitive drum 4 or the cleaning blade 7 is fixed with respect to the longitudinal direction of the photosensitive drum 4. Further, at each of longitudinal end portions of the cleaning blade 7, a cleaning blade end portion seal member (not shown) is provided.

The grip portion 45 is a portion where a user grips the cartridge P, and is mounted integrally with or as a separate part from the cleaning container 26. However, depending on the constitution of the image forming apparatus 1, in some cases, a mounting and demounting attitude, described later, of the cartridge P relative to the apparatus main assembly 2 is different from that in this embodiment. In that case, the grip portion 45 may also be provided on the developing frame 29.

In this embodiment, the cartridge P is the substantially rectangular parallelopiped. Of six sides, a side 58 includes an exposed portion 4*b* for permitting transfer of the toner image from the photosensitive drum 4 onto the intermediary transfer belt unit 11 described above. A side 59 opposite from the side 58 includes the above-described grip portion 45.

Further, as shown in (a) and (b) of FIG. 4, the cartridge P includes the following portions as portions where its positions in a packing member 46 are limited when the cartridge P is packed in the packing member 46 described later. That is, first portions-to-be-limited 24*b*, 25*b*, 24*g* and 25*g* are positionally limited relative to the packing member 46 with respect to a vertically downward direction (Z2 direction) and horizontal direction (Y1 and Y2 directions). Further, movement of a second portion-to-be-limited 26*c* is limited relative to the packing member 46 with respect to a vertically upward direction (Z1 direction). Further movement of third portion-to-be-limited 24*f* and 25*f* is limited with respect to a longitudinal direction of the cartridge P (i.e., an axial direction of the photosensitive drum 4, X1 and X2 directions). Incidentally, with respect to the positional limitation of the cartridge P in the packing member 46 by using the above-described respective portion-to-be-limited will be specifically described later.

<Mounting and Demounting Constitution of Cartridge>

Next, a mounting and demounting operation of the cartridge P with respect to the apparatus main assembly 2 will be described.

FIG. 5 is a schematic sectional view showing a state in which a cartridge tray 43 is pulled out from the apparatus main assembly 2 and thus the cartridge P is detachably mountable to the cartridge tray 43. FIG. 6 is a schematic sectional view for illustrating an operation by which the cartridge P is demounted from and mounted into the cartridge tray 43.

As shown in FIG. 5, inside the apparatus main assembly 2, the cartridge tray 43 in which the cartridges P are mountable is provided. The cartridge tray 43 is constituted so as to be linearly movable (pullable and pushable) in G1 and G2 directions which are substantially the horizontal direction with respect to the apparatus main assembly 2. Further, the cartridge tray 43 is capable of being in a mounted position, and in a pulled-out position where the cartridge tray 43 is pulled out from the mounted position.

First, the mounting operation for mounting the cartridge P into the apparatus main assembly 2 will be described. The openable door 3 is opened, and then the cartridge tray 43 is moved in G1 direction indicated by an arrow in FIG. 5 to be moved to the pulled-out position. In this state, the cartridge P is mounted in the cartridge tray 43 from an arrow H1 direction to be held. The cartridge tray 43 holding the cartridge P is moved in an arrow G2 direction shown in FIG. 6, so that the cartridge tray 43 is moved to the mounted position. Then, the openable door 3 is closed, so that the mounting operation of the cartridge P into the apparatus main assembly 2 is completed.

Then, the demounting operation of the cartridge P from the apparatus main assembly 2 will be described. Similarly as in the mounting operation of the cartridge P into the apparatus main assembly 2 described above, the cartridge tray 43 is moved to the pulled-out position. In this state, the cartridge P is demounted in an arrow H2 direction shown in FIG. 6, so that the demounting operation of the cartridge P from the apparatus main assembly 2 is completed. By the above-described operations, the cartridge P is detachably mountable to the apparatus main assembly 2. Incidentally, a mounting process of the cartridge P from the packing member 46 into the apparatus main assembly 2 will be described later specifically.

<Structure of Developing Device>

As shown in FIGS. 3 and 7, the developing device 9 has an elongated shape in which the developing roller 6 as the developing means extends in a rotational axis direction as the longitudinal direction. In addition to the developing roller 6, the developing device 9 is constituted by the developing frame 29, a developing blade 31, developing device end portion seal members 34R and 34L, a flexible sheet member 35, and supplying roller shaft seals 37R and 37L (FIG. 7). Further, as shown in FIG. 3, the developing frame 29 includes a toner accommodating chamber 29*c* for accommodating the toner and includes an opening 29*b* for permitting discharge of the toner from the toner accommodating chamber 29*c*. The developing roller 6 and the developer supplying roller 33 are provided close to the opening 29*b*. Further, as shown in FIG. 7, end portions of a shaft (core material 6*a*) of the developing roller 6 are rotatably supported by a driving-side bearing 38 and a non-driving-side bearing 39 which are mounted on side surfaces of the developing frame 29. Further, at driving-side end portions of the core material 6*a* of the developing roller 6 and a core material 33*a* of the developer supplying roller 33, a developing roller gear 40 and a supplying roller gear 41 are provided, respectively, and are engaged with a developing device drive input gear 42. The developing device drive input gear 42 includes a developing device drive coupling 42*a* with which a drive output coupling (not shown) in the apparatus main assembly 2 side, so that a driving force of a driving motor (not shown) for the apparatus main assembly 2 is transmitted and thus the developing roller 6 and the developer supplying roller 33 are rotationally driven at a predetermined speed. The developing blade 31 is an about 0.1 mm-thick elastic metal plate, and a free end of the developing blade 31 with respect to a widthwise direction is contacted to the developing roller 6 counterdirectionally to the rotational direction (arrow E direction in FIG. 3).

As shown in FIG. 7, the developing device end portion seal members 34R and 34L are provided at ends of the opening of the developing frame 29, so that toner leakage from a gap between the developing frame 29 as a second frame and each of the developing blade 31 and the developing roller 6 is prevented. Further, the flexible sheet member 35 is provided in contact with the developing roller 6 along the longitudinal direction in a side where the sheet member 35 opposes the developing blade 31 at the opening of the developing frame 29, thus preventing the toner leakage from a gap between the developing frame 29 and the developing roller 6. Further, the supplying roller shaft seal members 37R and 37L are mounted on the core material 33*a* of the developer supplying roller 33 at exposed portions outside the developing frame 29, thus preventing the toner leakage from a gap between the core material 33*a* and a core material through hole 29*d* provided in the developing frame 29.

The developing device (developing unit) 9 is always urged by an urging spring (not shown) in a direction (arrow W1 direction in FIG. 3), in which the developing roller 6 is contacted to the photosensitive drum 4, with the swing center (axis a) shown in FIG. 4 as a center. During the image formation, by the drive, the developer supplying roller 33 and the developing roller 6 are rotated and rubbed with each other, so that the toner in the developer frame 29 is carried on the developing roller 6. The developing blade 31 regulates a thickness of a toner layer formed on a peripheral surface of the developing roller 6, and at the same time, imparts triboelectric charges, generated between itself and the developing roller 6 by contact pressure, to the toner. Then, at the contact portion between the developing roller 6 and the photosensitive drum 4, the charged toner on the developing roller 6 is deposited on the electrostatic latent image, so that the electrostatic latent image is developed.

Further, during non-image formation, the developing roller 6 is spaced from the photosensitive drum 4, thus preventing deformation thereof at its surface. That is, the developing device 9 is constituted so as to be movable relative to the cleaning unit 8 and thus is capable of moving the developing roller 6 toward and away from the photosensitive drum 4.

<Structure of Packing Member>

A structure of the packing member 46 will be described with reference to FIGS. 1, 8, 9 and 10.

Figure 1:
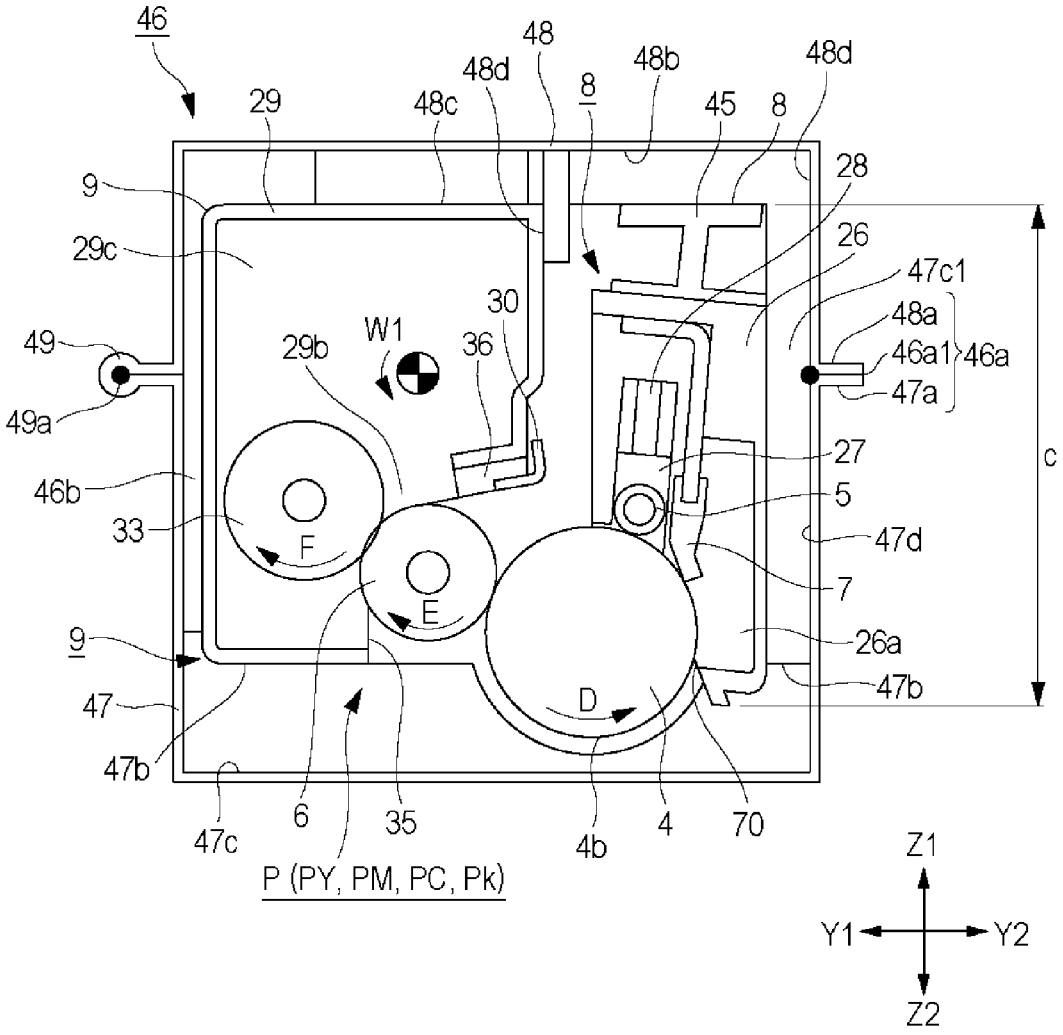
FIG. 1 is a schematic sectional view showing a packing state of a cartridge in a packing member in Embodiment 1.

FIG. 1 is a schematic sectional view showing a packing state of the cartridge P in the packing member 46 in this embodiment. Parts (a) and (b) of FIG. 8 are schematic perspective views, as seen from different angles, each showing the packing member 46 in this embodiment. Parts (a) and (b) of FIG. 9 are schematic perspective views, as seen from different angles, each showing a demountable state of the cartridge P from the packing member 46 in this embodiment. Here, a longitudinal direction of the packing member 46 is the same as the longitudinal direction (X1 and X2 directions) of the cartridge P when the cartridge P is accommodated in the packing member 46. FIG. 10 is a schematic perspective view showing the cartridge-packed state of the packing member 46 in this embodiment.

As shown in (a) and (b) of FIG. 8, the packing member 46 is constituted by a frame portion 47, a cap portion 48 and a hinge portion 49. The frame portion 47 and the cap portion 48 are rotatable, relative to each other, after a rotation shaft 49*a* of the hinge portion 49 (FIG. 1). Each of the frame portion 47, the cap portion 48 are the hinge portion 49 which constitute the packing member 46 is constituted by a thin plate (sheet) of plastic (resin material), such as polyethylene terephthalate or polypropylene, and the resin material can be molded by vacuum molding, press molding, or injection molding. However, the resin material can be molded inexpensive by employing the vacuum molding.

As shown in FIG. 8, the frame portion 47 includes a first recessed portion 47*c* having a recessed shape provided with a first opening 47*c*1. Further, the cap portion 48 includes a second recessed portion 48*b* having a recessed shape provided with a second opening 48*b*1. Further, at the frame portion 47 and the cap portion 48, flange portions 47*a* and 48*a* are formed so as to surround the first recessed portion 47*c* and the second recessed portion 48*b*, respectively. The frame portion 47 and the cap portion 48 are connected at the hinge portion 49, thus being integrally molded. Further, the cap portion 48 is capable of being located in a closed position where the cap portion 48 is capable of covering the first opening 47*c*1 of the frame portion 47 (FIGS. 1 and 11) and an open position where the first opening 47*c*1 is open (FIG. 12).

The mounting of the cartridge P in the packing member 46 will be described. The cartridge P is, as shown in (a) and (b) of FIG. 9, supported in a first state at the frame portion 47 of the packing member 46. This will be specifically described later. Here, in the first state, as shown in (a) and (b) of FIG. 9, the cartridge P inserted into the packing member 46 in an arrow Z2 direction through the first opening 47*c*1 is detachably mounted in the packing member 46. Further, in the first state, the cartridge P is held by the frame portion 47 and the frame portion 47 covers the exposed portion 4*b* ((b) of FIG. 4) of the photosensitive drum 4 of the cartridge P. Further, in the first state, the exposed portion 4*b* of the photosensitive drum 4 is prevented from contacting an inner surface of the frame portion 47 and a user is capable of gripping the grip portion 45 of the cartridge P. Further, from the state shown in (a) and (b) of FIG. 9, the cap portion 48 is rotated, about the rotation shaft 49*a* of the hinge portion 49, toward the frame portion 47, so that the flange portion 48*a* of the cap portion 48 is contacted to the flange portion 47*a* of the frame portion 47 as shown in FIG. 10. Thereafter, the flange portion 47*a* of the frame portion 47 and the flange portion 48*a* of the cap portion 48 are partly or wholly bonded to each other. As a result, as shown in FIG. 1, the first recessed portion 47*c* of the frame portion 47 and the second recessed portion 48*b* of the cap portion 48 form a connecting portion 46*a* (FIGS. 1 and 10) in combination. Thus, an accommodating space 46*b* is created inside the packing member 46, so that the packing member 46 is in a second state (packing state) in which the cartridge P is capable of being accommodated in the accommodating space 46*b* (FIG. 10). In this second state, the second recessed portion 48*b* of the cap portion 48 covers the entire cartridge P or a part of the cartridge P so as to accommodate the grip portion 45 of the cartridge P which is the substantially rectangular parallelopiped. Incidentally, the connecting portion 46*a* includes an unpacking portion 46*a*1 at an opposing position from the hinge portion 49. Although details will be described later, the user unseals (unpacks) the packing member 46 from the unpacking portion 46*a*1 of the connecting portion 46*a*. Further, it is also possible to employ a constitution in which the frame portion 47 and the cap portion 48 are not bonded at the unpacking portion 46*a*1. By the above-described packing, the whole cartridge P is covered with the frame portion 47 and the cap portion 48 to be placed in the packed state (FIGS. 1 and 10). Incidentally, in FIG. 1, the connecting portion 46*a* where the flange portion 47*a* of the frame portion 47 and the flange portion 48*a* of the cap portion 48 are connected with each other to accommodate the cartridge P is formed at a position which is roughly ½ of a height c of the cartridge P as seen from the longitudinal direction but is not limited thereto. For example, the connecting portion may also be provided above the upper point of the height c of the cartridge P. Further, the cartridge P is the substantially rectangular parallelopiped, and the packing member 46 includes the frame portion 47 and the cap portion 48 which are similar figures. However, the cartridge P may have any shape, and if the whole cartridge P or a part, of the cartridge P, to be protected, is covered with the packing member 46, also the packing member may have any shape. Further, as a bonding means between the flange portion 47*a* of the frame portion 47 and the flange portion 48*a* of the cap portion 48, it is possible to use (thermal) welding adhesive bonding, bonding with a double-side tape, hooking, or the like. However, the bonding means may only be required that the flange portions 47*a* and 48*a* can be bonded to each other, and is not limited to the above means. That is, it is also possible to employ a constitution in which the frame portion 47 and the cap portion 48 are separate members and the flange portions 47*a* and 48*a* are bonded to each other.

Next, in the packed state, positional limitation of the cartridge P by the packing member 46 will be described. In order to effect the positional limitation of the cartridge P with respect to the X1 and X2 direction, a pair of third limiting portions 47*f* formed as shown in (a) and (b) of FIG. 8 at inner surfaces, of the frame portion 47, corresponding to longitudinal ends of the cartridge P is contacted to third portions-to-be-limited 24*f* and 25*f* of the cartridge P shown in (a) and (b) of FIG. 9. Accordingly, the positions of the cartridge P with respect to the X1 and X2 directions are limited in the first state described above. Further, in order to effect the positional limitation of the cartridge P with respect to Y1 and Y2 directions and Z2 direction shown in (a) and (b) of FIG. 4, the packing member 46 includes first positions 47*g* and 47*b* formed at an upper surface of the frame portion 47 shown in (a) and (b) of FIG. 8. Here, in the Z2 direction, the cartridge P enters the frame portion 47. Further, the Y1 and Y2 directions are a direction which crosses (is perpendicular to) the longitudinal direction of the cartridge P and which crosses (is perpendicular to) Z2 direction in which the cartridge P enters the frame portion 47.

Then, the first limiting portions 47*g* and 47*b* are contacted to first portions-to-be-limited 24*g*, 25*g*, 24*b* and 24*a* shown in (a) and (b) of FIG. 9. Accordingly, the positions of the cartridge P with respect to the Y (Y1 and Y2) directions is limited in the first state described above. Further, as shown in (a) and (b) of FIG. 8, second limiting portions 48*c* are formed in the cap portion 48. Further, the second limiting portions 48*c* is, as shown in (a) and (b) of FIG. 9, formed at positions corresponding to second portions-to-be-limited 20*c* of the cartridge P in the packing state (second state) of the packing member 46. Further, with respect to the cartridge P, in the packing state (second state) the second portions-to-be-limited 26*c* contact the second limiting portions 48*c* of the cap portion 48. As a result, movement of the cartridge P in Z1 direction in which the cartridge P is spaced from the first limiting portions 47*b* is limited, so that the positional limitation of the cartridge is made. That is, in the first state shown in (a) and (b) of FIG. 9, the cartridge P is not limited with respect to the Z1 direction opposite to the direction of gravitation. In the above-described packing state (second state), the packing member 46 does not contact the cartridge P at portions other than the limiting portions 47*f*, 47*b*, 48*g* and 47*g* shown in FIG. 8. For that reason, the packing member 46 generates elastic deformation and plastic deformation at the portions other than the respective limiting portions when vibration and impact are generated during transportation, so that the packing member 46 is capable of absorbing the vibration and the impact during transportation. Therefore, the packing member 46 does not directly transmit the vibration and the impact during transportation to the photosensitive drum 4 and the process means and thus functions as a protecting member for protecting the cartridge P. Accordingly, it becomes also possible to eliminate a drum shutter, for protecting the photosensitive drum 4, from the cartridge P. Further, each of the limiting portions of the packing member 46 may be contacted to the cartridge P at any position if the position is not in a region where the electrostatic latent image is to be formed on the photosensitive drum 4 of the cartridge P. For example, even when the limiting portions are contacted to the developing frame 29, a similar effect can be obtained. However, when the third portions-to-be-limited 24*b* and 25*b* have high rigidity, the cartridge P is less broken by the impact or the like during transportation. Further, in the first state, the cartridge P has already by positionally limited by the frame portion 47 of the packing member 46 with respect to the X1, X2, Y1, Y2 and Z1 directions. That is, in order to fix the cartridge P in the packing member 46, when the state of the packing member 46 is changed from the first state to the second state, the cartridge P is only required to be covered with the cap portion 48, so that an assembling property can be further improved. Further, the limiting portions 47*f*, 47*b*, 48*c* and 47*g* are formed in the packing member 46 but may also be constituted as separate members.

As described above, as shown in (a) of FIG. 4, the developing device 9 is rotatably supported by the driving-side cover member 24 and the non-driving-side cover member 25 which are fixed on the cleaning unit 8 as described above. For that reason, as shown in (b) of FIG. 11, there is a possibility that the developing device 9 is rotationally moved in the clockwise direction (arrow W2 direction) against an urging force by the vibration and the impact generated during transportation of the cartridge P. At this time, the developing device 9 causes rotational motion by which the developing device 9 is restored to an attitude in which the developing device 9 is urged by the urging force, so that there is a possibility that the developing device 9 collides with the cleaning unit 8 and then friction memory between the photosensitive drum 4 and the developing roller 6 appears as an image defect. Further, in the above, the case where the developing device 9 includes the urging means such as the spring or the like has been described, but also in a constitution in which the developing device 9 does not include the urging means, during transportation of the cartridge P, there is a possibility that similar collision occurs. Here, a fixing method in which the developing device 9 in the member 46 during transportation of the cartridge P is not readily moved relative to the cleaning unit 8 will be described. Parts (a) and (b) of FIG. 11 are schematic sectional views each showing the packing state in which the cartridge P is packed in the packing member 46. Part (a) of FIG. 11 shows a state in which the developing device 9 is urged toward the cleaning frame (unit) 9 by a spring (not shown) or the like in the counterclockwise direction (arrow w1 direction) and in which the developing roller 6 contacts the photosensitive drum 4. On the other hand, (b) of FIG. 11 shows a state in which the developing device 9 is rotationally moved relative to the cleaning frame 9 in the clockwise direction (arrow w1 direction) against the urging force.

The developing device 9 includes a fourth portion-to-be-limited 29*d*. Further, the cap portion 48 of the packing member 46 includes a fourth limiting portion 48*d* formed therein. That is as shown in (a) of FIG. 11, with respect to the counterclockwise direction (arrow w1 direction) with the rotation axis a ((a) of FIG. 4) as the center, the fourth limiting portion 48*d* is provided downstream of the fourth portion-to-be-limited. Therefore, when the cartridge P is packed in the packing member 46, the fourth portion-to-be-limited 29*d* of the developing device 9 is supported by the fourth limiting portion 48*d*, so that excessive rotational movement of the developing device 9 in the clockwise direction (arrow w2 direction in (b) of FIG. 11) can be suppressed. As described above, by providing the fourth portion-to-be-limited 29*d* as a part of the developing device 9 and by forming the fourth limiting portion 48*d* as a part of the cap portion 48 of the packing member 46, it is possible to suppress the excessive rotational movement of the developing device 9 in the clockwise direction (arrow w2 direction in (b) of FIG. 11). As a result, a degree of the collision between the developing device 9 and the cleaning unit 8 due to the vibration and the impact generated during transportation of the cartridge P can be reduced. As a result, e.g., it is possible to reduce a degree of memory on the photosensitive drum 4 due to friction (sliding) between the developing roller 6 and the photosensitive drum 4.

<Relationship Between Grip Portion and Packing Member>

A positional relationship between the grip portion 45 of the cartridge P and the packing member 46 will be described with reference to FIG. 11. The cartridge P includes the grip portion 45 provided as a part of the cleaning unit 8, and is packed in an attitude in which the cleaning unit 8, the developing device 9 and the hinge portion 49 are arranged in this order in Y1 direction. However, as described above, the grip portion 45 is provided as a part of the developing device in some cases. In the case, the cartridge P is packed in an attitude in which the hinge portion 49, the cleaning unit 8 and the developing device 9 are arranged in Y1 direction.

A demounting operation of the cartridge P from the packing member 46 will be described with reference to FIGS. 10 and 12. FIG. 12 is a schematic sectional view showing a state in which the cartridge P is demountable (detachable) from the packing member 46. The demounting operation of the cartridge P is performed in the order of uncovering of the cap portion 48, grip of the grip portion 45, demounting of the cartridge P and mounting of the cartridge P into the apparatus main assembly 2.

In FIG. 10, the user separates the connecting portion 46*a* of the cap portion 48, connected openably with the frame portion 47, from an unpacking portion 46*a*1 by an unshown means. That is, from the connecting portion 46*a* where the flange portion 47*a* is located, the flange portion 48*a* is separated. Then, the user rotationally moves the cap portion 48 about a rotation shaft 49*a* of the hinge portion 49 as an axis in an arrow R direction in FIG. 12. By about 180-degree rotational movement of the cap portion 48, the cartridge P is in a demountable state (FIG. 12), so that the uncovering operation of the cap portion 48 is completed. Incidentally, if the cartridge P is demountable, the cap portion 48 may also be not rotated by 180 degrees. Here, the user easily performs the uncovering operation of the packing member 46 in the case where the unpacking portion 46*a*1 is disposed in the front side rather than in the case where the hinge portion 49 is disposed in the front side. In the following, the uncovering by the user is performed in the state in which the unpacking portion 46*a*1 of the packing member 46 is disposed in the front side.

Then, the user grips the grip portion 45. The grip of the grip portion 45 by the user is made by gripping the grip portion 45 after the user rotationally moves the cap portion 48. At this time, as described above, the grip portion 45 is located in the unpacking portion 46*a*1 side. For that reason, the user easily recognizes the grip portion 45 when the cap portion 48 is uncovered and can smoothly perform the grip of the grip portion 45 with no obstruction to a gripping operation by the cap portion 48.

Next, a mounting operation of the cartridge P, after being demounted, into the apparatus main assembly 2 will be described. This operation is performed, after the user demount the cartridge P by moving the cartridge P in an arrow J direction shown in FIG. 12, by mounting the cartridge P into the apparatus main assembly 2. When the user mounts the cartridge P into the apparatus main assembly 2, the user is positioned in a downstream side of the apparatus main assembly 2 with respect to a pulling-out direction G1 of the cartridge tray 43 shown in FIG. 5. Further, an attitude of the cartridge P when the user mounts the cartridge P into the apparatus main assembly 2 is such that the cleaning unit 8 is located downstream of the developing device 8 with respect to the pulling-out direction G1. Further, in the attitude, with respect to the mounting direction H1 of the cartridge P shown in FIG. 6, the photosensitive drum 4 is located in the downstream side and the grip portion 45 is located in the upstream side. This attitude is the same as that of the cartridge P when the user grips the grip portion 45 of the cartridge P accommodated in the packing member 46. That is, the user can mount the cartridge P into the apparatus main assembly in the attitude, in which the user demount the cartridge P from the packing member 46, as it is. Therefore, the user is free from inconveniences, such that the cartridge P is shifted from one hand to the other and such that the wrist is twisted, during the mounting of the cartridge P, after being demounted, into the apparatus main assembly 2, thus leading to improvement in usability.

As described above, in this embodiment, when the vibration and the impact during transportation are generated, the packing member 46 permits generation of elastic deformation and plastic deformation at portions other than the respective limiting portions and thus is capable of absorbing the vibration and the impact during transportation. The packing member 46 functions as a cartridge packing member capable of protecting the cartridge P from the vibration and the impact during transportation.

Further, the cartridge P is constituted by the first frame 8 as the cleaning frame for rotatably supporting the photosensitive drum 4 and by the second frame 9 as the developing frame, supported by the first frame 8, for supporting the process means. Further, the packing member 46 includes the fourth limiting portion 48*d* for limiting movement of the second frame 9 in the accommodating space 46*b*. As a result, with respect to the cartridge P, rotation of the second frame 9 in the direction in which the process means are spaced from the photosensitive drum 4 is limited, so that the vibration and impact during transportation are suppressed.

Further, the cartridge P has the grip portion 45, to be gripped for demounting the cartridge P from the packing member, at a develop opposite from the photosensitive drum 4. At this time, in a cross section perpendicular to the axial direction of the photosensitive drum 4, the photosensitive drum 4 is disposed in the frame portion 47 side and the grip portion 45 is disposed in the cap portion 48 side. As a result, the user can take out the cartridge P from the packing member 46 without impairing the usability during unpacking of the cartridge P from the packing member 46.

Incidentally, in this embodiment, the constitution in which the cartridge P is formed in the substantially rectangular parallelopiped shape and the grip portion 45 is disposed at a surface opposite from the exposed portion of the photosensitive drum 4 is employed, but the present invention is not limited thereto. When the cartridge P is packed in the packing member 46, it is also possible to apply the present invention when a constitution such that the exposed portion 4*b* is accommodated in the first recessed portion 47*c* of the frame portion 47 and the grip portion 45 is accommodated in the second recessed portion 48*b* of the cap portion 48 is employed. For example, the cartridge is formed in a substantially triangular prism shape and an exposed portion is provided in a side other than triangular sides. At this time, the grip portion is disposed in a side which is not opposite from the exposed portion side. Also in this case, the present invention is applicable when the cartridge is packed in the packing member, a constitution in which the exposed portion is accommodated in a recessed portion of the frame portion and the grip portion is accommodated in a recessed portion of the cap portion may only be required to be employed.

As described above, this embodiment relates to the packing member 46 for packing the cartridge P and relates to the cartridge P packed in the packing member 46. Here, the cartridge P is constituted by the cleaning unit 8 as the first frame including the grip portion 45 and the developing device 9 as the second frame. Further, the packing member 46 is constituted by the frame portion 47 and the cap portion 48 which are connected by the hinge portion 49 as a rotation shaft for rotatably supporting the frame portion 47 and the cap portion 48 relative to each other. The frame portion 47 includes the first recessed portion 47*c*, and the cap portion 48 includes the second recessed portion 48*b*. Further, each of these portions 47 and 48 of the packing member 46 is rotatable about the hinge portion 49 as a rotation center, and the first recessed portion 47*c* and the second recessed portion 48*b* form the accommodating space 46*b* which is a space for accommodating the cartridge P. The cartridge P is positionally limited by the limiting portions 47*g* and 47*b* in the following manner when the cartridge P is packed in the accommodating space 46*b* of the packing member 46. That is, with respect to the direction perpendicular to the axial directions X1 and X2 of the photosensitive drum 4 and with respect to the direction crossing the entering direction in which the cartridge P enters the frame portion 47, a state in which the hinge portion 49, the developing device 9 and the cleaning unit 8 are arranged in this order is created. As a result, the user is easy to recognize the grip portion 45 since when the user unpacks the packing member 46 in the front side where the unpacking portion 46*a*1 is located, the grip portion 45 of the cleaning unit 8 is closer in position to the user. Further, the cap portion 48 does not obstruct the gripping operation, and therefore the user is easy to grip the grip portion 45. For that reason, the user can smoothly demount the cartridge P from the packing member 46. Further, an attitude of the cartridge P when the user demounts the cartridge P from the packing member 46 and an attitude of the cartridge P when the user mounts the cartridge P into the apparatus main assembly 2 are substantially coincide with each other. For that reason, during a period from the demounting of the cartridge P from the packing member 46 to the mounting of the cartridge P into the apparatus main assembly 2, the user can reduce an operation, to the possible extent, in which the user shifts the cartridge P from one hand to the other or twists the user is wrist. For that reason, according to this embodiment, usability is remarkably improved.

Embodiment 2

Embodiment 2 will be described with reference to FIGS. 13 to 15. In Embodiment 2, in place of the cartridges P each constituted by the cleaning unit 8 and the developing device 9 in Embodiment 1, cartridges Q (QY, QM, QC, QK) each constituted by only the developing device are used. For that reason, with respect to portions common to Embodiments 1 and 2, description of the portions will be omitted.

<General Structure of Image Forming Apparatus>

First, FIG. 14 is a schematic sectional view of an image forming apparatus 100 in this embodiment.

The image forming apparatus 1 is a four color-based full-color laser printer using the electrophotographic image forming process and effects color image formation on a recording material S. In the image forming apparatus 100, the cartridge Q is, as shown in FIG. 14, detachably mountable to an apparatus main assembly 102 and a color image is formed on the recording material S.

However, in this embodiment, a constitution in which the cartridge Q is detachably mountable to the apparatus main assembly 102 is employed but the present invention is not limited thereto. It is also possible to employ a constitution in which the cleaning unit 8 is detachably mountable to the apparatus main assembly 102. Incidentally, other parts, of the apparatus main assembly 102, having the same functions as those in Embodiment 1 are represented by the same reference numerals or symbols and will be omitted from description.

<Structure of Cartridge>

Parts (a) and (b) of FIG. 13 are schematic perspective views each showing the cartridge Q in this embodiment, in which (a) is the schematic perspective view of the cartridge Q as seen from the driving side, and (b) is the schematic perspective view of the cartridge Q as seen from the non-driving side. The cartridge Q includes a grip portion 145. The grip portion 145 is a portion to be gripped by the user, and is mounted on a developing (device) frame 129 integrally or as a separate member. Further, the cartridge Q is the substantially rectangular parallelopiped. Of six sides, a side 158 includes an exposed portion 6*b* for permitting development of the electrostatic latent image on the photosensitive drum 4 with the toner on the developing roller 6. A side 159 opposite from the side 158 includes the above-described grip portion 145. The position of the grip portion 145 will be described later.

The cartridge Q includes, as portion to be positionally limited in a packing member 146 when the cartridge Q is packed in the packing member 146 described later, third portions-to-be-limited 139*f* and 144*f*, first portions-to-be-limited 129*b*, 144*b*, 139*g* and 144*g*, and a second portion-to-be-limited 129*c*.

The third portions-to-be-limited 139*f* and 144*f* are used for positional limitation of the cartridge Q in the packing member 146 described later with respect to the longitudinal direction (X (X1, X2) direction in FIG. 10) which is the axial direction of the developing roller 6. The first portions-to-be-limited 139*b* and 144*b* and the second portion-to-be-limited 129*c* are used for positional limitation of the cartridge Q with respect to Y1 and Y2 directions perpendicular to (crossing) the X1 and X2 directions and with respect to Z1 direction as the vertically downward direction, respectively. The positional limitation of the cartridge Q in the packing member 146 by using the respective portions-to-be-limited will be specifically described later.

Other constitutions are the same as those of the developing device 9 described in Embodiment 1 and therefore will be omitted from description.

<Mounting and Demounting Constitution of Cartridge>

Next, a mounting and demounting operation of the cartridge Q with respect to the apparatus main assembly 102 will be described.

FIG. 14 is a schematic sectional view showing a state in which a cartridge tray 43 is pulled out from the apparatus main assembly 102 and thus the cartridge Q is detachably mountable to the cartridge tray 43, and is a schematic sectional view for illustrating an operation by which the cartridge Q is demounted from and mounted into the cartridge tray 43.

Inside the apparatus main assembly 102, the cartridge tray 43 in which the cartridges Q are mountable is provided. Further, in the cartridge tray 43, the cleaning unit 8 is mounted in advance. The cartridge tray 43 is, as shown in FIG. 14, constituted so as to be linearly movable (pullable and pushable) in G1 and G2 directions which are substantially the horizontal direction with respect to the apparatus main assembly 102. Further, the cartridge tray 43 is capable of being in a mounted position in the apparatus main assembly 102 and in a pulled-out position where the cartridge tray 43 is pulled out from the mounted position.

First, the mounting operation for mounting the cartridge Q into the apparatus main assembly 102 will be described. The openable door 3 is opened, and then the cartridge tray 43 is moved in G1 direction indicated by an arrow in FIG. 14 to be moved to the pulled-out position. In this state, the cartridge Q is mounted in the cartridge tray 43 from an arrow H1 direction in FIG. 14, so that an exposed portion 6*b* (FIG. 13) of the developing roller 6 is positioned at an opposing portion to the photosensitive drum 4. Then, the cartridge tray 43 is moved in an arrow G2 direction shown in FIG. 14, so that the cartridge tray 43 is moved to the mounted position in the apparatus main assembly 102. Then, the openable door 3 is closed, so that the mounting operation of the cartridge Q into the apparatus main assembly 102 is completed.

On the other hand, the demounting operation of the cartridge Q from the apparatus main assembly 102 will be described. First, the cartridge tray 43 is moved in the arrow G1 direction in FIG. 14 to the pulled-out position. In this state, the cartridge Q is demounted in an arrow H2 direction shown in FIG. 14, so that the demounting operation of the cartridge Q from the apparatus main assembly 102 is completed. By the above-described operations, the cartridge Q is detachably mountable to the apparatus main assembly 102, Incidentally, in this embodiment, the cleaning 8 is mounted in the cartridge tray 43 in advance, but the constitution is not limited thereto. It is also possible to employ a constitution in which the cleaning unit 8 is disposed in the apparatus main assembly 102 in advance. A process from demounting of the cartridge Q from the packing member 143 until the cartridge Q is mounted into the apparatus main assembly 102 will be described specifically.

<Structure of Packing Member>

A structure of the packing member 146 will be described with reference to FIG. 15.

Incidentally, constituent elements of the packing member 146 similar to those in Embodiment 1 will be omitted from description.

FIG. 15 is a schematic sectional view showing a packing state of the cartridge Q in the packing member 46 in this embodiment.

The packing member 146 is constituted by a frame portion 147, a cap portion 148 and a hinge portion 149. The frame portion 147 and the cap portion 148 are rotatable, relative to each other, after a rotation shaft 149*a* of the hinge portion 149. Each of the frame portion 147, the cap portion 148 are the hinge portion 149 which constitute the packing member 146 is constituted by a thin film of plastic (resin material), such as polyethylene terephthalate or polypropylene and the resin material can be molded by vacuum molding, press molding, or injection molding. However, similarly as in Embodiment 1, the packing member 146 is processable at low cost by being formed by the vacuum molding.

Further, the packing member 146 includes a connecting portion 146*a* for unpacking the packing member 146. The connecting portion 146*a* is located in a position where it is opposite from the hinge portion 149 in the packing state of the packing member 146.

The frame portion 147 includes a first recessed portion 147*c* having a recessed shape provided with a first opening 147*c*1. Further, the cap portion 148 includes a second recessed portion 148*b* having a recessed shape provided with a second opening 148*b*1. Further, at the frame portion 147 and the cap portion 148, flange portions 147*a* and 148*a* are formed so as to surround the first recessed portion 147*c* and the second recessed portion 148*b*, respectively. The frame portion 147 and the cap portion 148 are connected at the hinge portion 149, thus being integrally molded. Further, the cap portion 148 is capable of being located in a closed position where the cap portion 148 is capable of covering the first opening 147*c*1 of the frame portion 147 (FIGS. 1 and 11) and an open position where the first opening 147*c*1 is open.

Next, the fixing of the cartridge Q in the packing member 146 will be described. The cartridge Q is supported in a first state at the frame portion 147 of the packing member 146. This will be specifically described later. In the first state, the cartridge Q inserted into the packing member 146 through the first opening 147*c*1 is detachably mounted in the packing member 146. Further, in the first state, the cartridge Q is held by the frame portion 147 and the frame portion 147 covers the exposed portion 6*b* of the developing roller 6 of the cartridge Q. Further, in the first state, the exposed portion 6*b* of the developing roller 6 is prevented from contacting an inner surface of the frame portion 147 and the cap portion 148 is rotated, relative to the frame portion 147, about a rotation shaft 149*a* of the hinge portion 149, and a user is capable of gripping the grip portion 145 of the cartridge Q. Further, from the above-described packing state (not shown), the cap portion 148 is rotated, about the rotation shaft 149*a* of the hinge portion 149, toward the frame portion 147, so that the flange portion 148*a* of the cap portion 148 is contacted to the flange portion 147*a* of the frame portion 147 as shown in FIG. 15. Thereafter, the flange portion 47*a* of the frame portion 47 and the flange portion 48*a* of the cap portion 48 which oppose each other are partly or wholly bonded to each other. As a result, as shown in FIG. 15, the first recessed portion 147*c* of the frame portion 147 and the second recessed portion 148*b* of the cap portion 148 form a connecting portion 146*a* in combination, thus creating an accommodating space 146*b* inside the packing member 146, so that the packing member 146 is capable of being accommodated in the accommodating space 146*b*. In this state, the second recessed portion 148*b* of the cap portion 148 covers the entire cartridge Q or a part of the cartridge Q so as to accommodate the grip portion 145 of the cartridge Q which is the substantially rectangular parallelopiped. By the above-described packing, the whole cartridge Q is covered with the frame portion 147 and the cap portion 148 to be placed in the packing state (second state) (FIG. 15).

Next, in the packed state, positional limitation of the cartridge Q by the packing member 146 will be described. In order to effect the positional limitation of the cartridge Q with respect to the X (X1 and X2) direction, a pair of third limiting portions (not shown) formed at inner surfaces of the frame portion 147 is contacted to the third portions-to-be-limited 139*f* and 144*f* of the cartridge Q shown in (a) and (b) of FIG. 13. Accordingly, the positions of the cartridge Q with respect to the X1 and X2 directions are limited in the first state described above. Further, the positional limitation of the cartridge Q with respect to Y1 and Y2 directions and Z2 direction shown in FIG. 15 is effected. For that purpose, the first limiting portions 147*g* and 147*b* formed at the inner surface of the frame portion 148 of the packing member 146 are contacted to first portions-to-be-limited 144*g* and 144*b* shown in (a) and (b) of FIG. 13. Accordingly, the positions of the cartridge Q with respect to the Y1, Y2, and Z directions is limited in the first state described above. Further, as shown in FIG. 15, the second limiting portion 148*c* is formed in the cap portion 148. Further, the second limiting portion 148*c* is formed at a position corresponding to second portion-to-be-limited 129*c* of the cartridge Q in the packing state (second state) of the packing member 146. Further, with respect to the cartridge Q, in the packing state (second state) the second portion-to-be-limited 129*c* contacts the second limiting portion 148*c* of the cap portion 148. As a result, the positional limitation of the cartridge Q in Z1 direction is made. That is, in the first state, the cartridge Q is not limited with respect to the Z1 direction opposite to the direction of gravitation. In the above-described packing state (second state), the packing member 146 does not contact the cartridge Q at portions other than the limiting portion 144*f*, 147*b*, 148*g* and 147*g* shown in FIG. 15. For that reason, similarly as in Embodiment 1, the packing member 146 generates elastic deformation and plastic deformation at the portions other than the respective limiting portions when vibration and impact are generated during transportation, so that the packing member 146 is capable of absorbing the vibration and the impact during transportation. Therefore, the packing member 146 does not directly transmit the vibration and the impact during transportation to the developing roller 6 and other process means and thus functions as a protecting member for protecting the cartridge Q. Further, each of the limiting portions of the packing member 146 may be contacted to the cartridge Q at any position if the position is not in a region where the development is to be made by using the developing roller 6 of the cartridge Q. However, when the third portions-to-be-limited 139*b* and 144*b* have high rigidity, the cartridge Q is less broken by the impact or the like during transportation. Further, in the first state, the cartridge Q has already by positionally limited by the frame portion 147 of the packing member 146 with respect to the longitudinal direction Y1, Y2 and Z1 directions. That is, in order to fix the cartridge Q in the packing member 146, when the state of the packing member 146 is changed from the first state to the second state, the cartridge Q is only required to be covered with the cap portion 148, so that an assembling property can be further improved. Further, the third limiting portions 144*f*, 147*b*, 148*c* and

147*g* are formed in the frame portion 147 and cap portion 148 of the packing member 146 but may also be constituted as separate members.

<Relationship Between Grip Portion and Packing Member>

A positional relationship between the grip portion 145 of the cartridge Q and the packing member 146 will be described with reference to FIG. 15. With respect to the Y2 direction, as shown in FIG. 15, the closest edge line, to the hinge portion 149, of the cartridge Q is a first edge line 109*a*, and the remotest edge line, from the hinge portion 149, of the cartridge Q is a second edge line 109*b*. Further, with respect to the Y2 direction, a medium line between the first and second edge lines 109*a* and 109*b* is a center line m. In this case, the grip portion 145 is provided in the right side of the center line m in FIG. 15 (with respect to Y2 direction). Further, in this case, when the cartridge Q is packed in the packing member 146, the cartridge Q is in an attitude such that the grip portion 145 is disposed in a side opposite from the hinge portion 149 side with respect to the center line m. Further, the demounting operation of the cartridge Q from the packing member 146 is the same as that in Embodiment 1 in which the cartridge P is replaced with the cartridge Q in this embodiment, and therefore will be omitted from description.

As described above, this embodiment relates to the packing member 146 for packing the cartridge Q and relates to the cartridge Q packed in the packing member 146. Here, the cartridge Q includes the grip portion 145 and at least one of the photosensitive drum as the image bearing member and the process means actable on the photosensitive drum. Further, the packing member 146 is constituted by the frame portion 147 and the cap portion 148 which are connected by the hinge portion 149 as a rotation shaft for rotatably supporting the frame portion 147 and the cap portion 148 relative to each other. The frame portion 147 includes the first recessed portion 147*c*, and the cap portion 148 includes the second recessed portion 148*b*. Further, each of these portions 147 and 148 of the packing member 46 is rotatable about the rotation shaft 149 as a rotation center, and the first recessed portion 147*c* and the second recessed portion 148*b* form the accommodating space 146*b* which is a space for accommodating the cartridge Q. The cartridge Q is positionally limited by the limiting portions 147*g* and 147*b* in the following manner when the cartridge Q is packed in the accommodating space 46*b*. That is, with respect to the direction perpendicular to the axial directions X1 and X2 of the developing roller 6 and with respect to the direction crossing the entering direction in which the cartridge Q enters the frame portion 147, a state in which the hinge portion 149 is located in a position remoter from the hinge portion 149 than the center line m is created. As a result, the user is easy to recognize the grip portion 145 since when the user unpacks the packing member 146 in the front side where the unpacking portion 146*a*1 is located, the grip portion 145 is closer in position to the user. Further, the cap portion 148 does not obstruct the gripping operation, and therefore the user is easy to grip the grip portion 145. For that reason, the user can smoothly demount the cartridge Q from the packing member 146. Further, an attitude of the cartridge Q when the user demounts the cartridge Q from the packing member 146 and an attitude of the cartridge Q when the user mounts the cartridge Q into the apparatus main assembly 102 are substantially coincide with each other. For that reason, during a period from the demounting of the cartridge Q from the packing member 146 to the mounting of the cartridge Q into the apparatus main assembly 102, the user can reduce an operation, to the possible extent, in which the user shifts the cartridge Q from one hand to the other or twists the user is wrist. For that reason, according to this embodiment, usability is remarkably improved.

INDUSTRIAL APPLICABILITY

As described hereinabove, according to the present invention, it is possible to protect the cartridge from the vibration and impact during transportation with a simpler constitution.

The invention claimed is:

1. A packing member for packing a cartridge which is detachably mountable to an image forming apparatus and which includes a grip portion provided, for gripping the cartridge, in a position deviated from a center line passing through a center of the cartridge with respect to a lateral direction crossing a longitudinal direction of the cartridge, said packing member comprising:

(i) a frame portion including an opening as an entrance for the cartridge and a recessed portion for accommodating the cartridge; and (ii) a cap portion, provided rotatably connected to an end portion of said frame portion with respect to the lateral direction by a hinge portion, for openably covering the opening, wherein said recessed portion comprises a plurality of limiting portions, with respect to the lateral direction, for limiting a position of the cartridge with respect to the lateral direction so that the cartridge is located in a position where the grip portion is more remote from said hinge portion than the center line of the cartridge is from said hinge portion with respect to the lateral direction.

2. A packing member according to claim 1, wherein said recessed portion is a first recessed portion, and wherein said cap portion includes a second recessed portion for accommodating the grip portion and for forming a space for accommodating the cartridge together with said first recessed portion when the opening is covered.

3. A packing member according to claim 1, wherein said hinge portion is integrally molded with said frame portion and said cap portion.

4. A packing member according to claim 1, wherein said hinge portion is provided along the longitudinal direction.

5. A packing member according to claim 1, wherein the cartridge includes a photosensitive drum on which an electrostatic latent image is to be formed, and wherein the longitudinal direction is an axial direction of the photosensitive drum.

6. A packing member for packing a cartridge which is detachably mountable to an image forming apparatus and which includes a first frame including a grip portion for gripping the cartridge and includes a second frame connected to the first frame said packing member comprising:

(i) a frame portion including an opening as an entrance for the cartridge and a recessed portion for accommodating the cartridge; and (ii) a cap portion, provided rotatably connected to an end portion of said frame portion with respect to a lateral direction of the cartridge by a hinge portion, for openably covering the opening, wherein said recessed portion comprises a plurality of limiting portions, with respect to the lateral direction, for limiting a position of the cartridge with respect to the lateral direction so that the cartridge is located in a position where said grip portion is more remote from said hinge portion than a center line of the cartridge is from said hinge portion with respect to the lateral direction.

7. A packing member according to claim 6, wherein said recessed portion is a first recessed portion, and wherein said cap portion includes a second recessed portion for accommodating the grip portion and for forming a space for accommodating the cartridge together with said first recessed portion when the opening is covered.

8. A packing member according to claim 6, wherein said hinge portion is integrally molded with said frame portion and said cap portion.

9. A packing member according to claim 6, wherein said hinge portion is provided along the longitudinal direction.

10. A packing member according to claim 6, wherein the first frame includes a photosensitive drum on which an electrostatic latent image is to be formed, wherein the second frame includes a developing roller for developing the electrostatic latent image, and wherein the longitudinal direction is an axial direction of the photosensitive drum.

11. A cartridge, packed in a packing member, detachably mountable to an image forming apparatus, wherein said cartridge includes a grip portion provided, for gripping said cartridge, in a position deviated from a center line passing through a center of said cartridge with respect to a lateral direction crossing a longitudinal direction of said cartridge, and wherein said packing member comprises:

(i) a frame portion including an opening as an entrance for said cartridge and a recessed portion for accommodating said cartridge; and (ii) a cap portion, provided rotatably connected to an end portion of said frame portion with respect to the lateral direction by a hinge portion, for openably covering the opening, wherein said recessed portion comprises a plurality of limiting portions, with respect to the lateral direction, for limiting a position of said cartridge with respect to the lateral direction so that said cartridge is located in a position where said grip portion is more remote from said hinge portion than the center line of said cartridge is from said hinge position with respect to the lateral direction.

12. A cartridge according to claim 11, wherein said recessed portion is a first recessed portion, and wherein said cap portion includes a second recessed portion for accommodating said grip portion and for forming a space for accommodating said cartridge together with said first recessed portion when the opening is covered.

13. A cartridge according to claim 11, wherein said hinge portion is integrally molded with said frame portion and said cap portion.

14. A cartridge according to claim 11, wherein said hinge portion is provided along the longitudinal direction.

15. A cartridge according to claim 11, wherein said cartridge includes a photosensitive drum on which an electrostatic latent image is to be formed, and wherein the longitudinal direction is an axial direction of said photosensitive drum.

16. A cartridge, packed in a packing member, detachably mountable to an image forming apparatus wherein said cartridge includes a first frame including a grip portion for gripping said cartridge and includes a second frame connected to said first frame, and wherein said packing member comprises:

(i) a frame portion including an opening as an entrance for said cartridge and a recessed portion for accommodating said cartridge; and (ii) a cap portion, provided rotatably connected to an end portion of said frame portion with respect to a lateral direction of said cartridge by a hinge portion, for openably covering the opening, wherein said recessed portion comprises a plurality of limiting portions, with respect to the lateral direction, for limiting a position of said cartridge with respect to the lateral direction so that said cartridge is located in a position where said grip portion is more remote from said hinge portion than a center line of said cartridge is from said hinge position with respect to the lateral direction.

17. A cartridge according to claim 16, wherein said recessed portion is a first recessed portion, and wherein said cap portion includes a second recessed portion for accommodating said grip portion and for forming a space for accommodating said cartridge together with said first recessed portion when the opening is covered.

18. A cartridge according to claim 16, wherein said hinge portion is integrally molded with said frame portion and said cap portion.

19. A cartridge according to claim 16, wherein said hinge portion is provided along the longitudinal direction.

20. A cartridge according to claim 16, wherein said first frame includes a photosensitive drum on which an electrostatic latent image is to be formed, wherein said second frame includes a developing roller for developing the electrostatic latent image, and wherein the longitudinal direction is an axial direction of said photosensitive drum.

* * * * *